US007693476B2

(12) United States Patent
Hatakeyama et al.

(10) Patent No.: US 7,693,476 B2
(45) Date of Patent: Apr. 6, 2010

(54) IMAGE FORMING APPARATUS WITH PROTECTIVE AGENT APPLYING UNIT AND PROCESS CARTRIDGE

(75) Inventors: Kumiko Hatakeyama, Kanagawa (JP); Toshiyuki Kabata, Kanagawa (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/867,512

(22) Filed: Oct. 4, 2007

(65) Prior Publication Data

US 2008/0089726 A1 Apr. 17, 2008

(30) Foreign Application Priority Data

Oct. 6, 2006 (JP) ..... 2006-275216
Oct. 12, 2006 (JP) ..... 2006-278818
Oct. 12, 2006 (JP) ..... 2006-278828

(51) Int. Cl.
*G03G 21/00* (2006.01)

(52) U.S. Cl. ..... 399/346

(58) Field of Classification Search ..... 399/346
See application file for complete search history.

(56) References Cited

U.S. PATENT DOCUMENTS

2005/0084305 A1* 4/2005 Nishida et al. ..... 399/346
2005/0191099 A1* 9/2005 Yamaguchi et al. ..... 399/346
2005/0244176 A1* 11/2005 Nakai et al. ..... 399/44

FOREIGN PATENT DOCUMENTS

JP 51-22380 7/1976
JP 52-36016 3/1977
JP 7-281504 10/1995
JP 2000-75752 3/2000
JP 2001-331063 11/2001
JP 2002-341694 11/2002
JP 2004-21109 1/2004
JP 2004-133264 4/2004
JP 2004-138632 5/2004
JP 2004-191656 7/2004
JP 2004-198662 7/2004
JP 2004-252259 9/2004
JP 2004-333961 11/2004

(Continued)

OTHER PUBLICATIONS

U.S. Appl. No. 12/033,496, filed Feb. 19, 2009, Hatakeyama, et al.

*Primary Examiner*—Quana M Grainger
(74) *Attorney, Agent, or Firm*—Oblon, Spivak, McClelland, Maier & Neustadt, L.L.P.

(57) ABSTRACT

An image forming apparatus includes a charger, a developing device, a cleaning device, a protective-agent bar, and a brush. The charger uniformly charges an image carrier. The developing device develops an electrostatic latent image formed on the image carrier to obtain a toner image as a visual image. The cleaning device removes toner remaining on the surface of the image carrier from which the toner image has been transferred onto a transfer material. The protective-agent bar contains a protective agent. The brush comes in contact with the protective-agent bar and the image carrier while rotating such that the protective agent adheres thereto and is supplied to the image carrier in an irregular form.

18 Claims, 5 Drawing Sheets

FOREIGN PATENT DOCUMENTS

| | | |
|---|---|---|
| JP | 2005-17469 | 1/2005 |
| JP | 2005-171107 | 6/2005 |
| JP | 2005-250346 | 9/2005 |
| JP | 2005-275166 | 10/2005 |
| JP | 2006-3614 | 1/2006 |
| JP | 2006-30955 | 2/2006 |
| JP | 2006-113499 | 4/2006 |

* cited by examiner

IMAGE FORMING APPARATUS WITH PROTECTIVE AGENT APPLYING UNIT AND PROCESS CARTRIDGE

CROSS-REFERENCE TO RELATED APPLICATIONS

The present application claims priority to and incorporates by reference the entire contents of Japanese priority documents, 2006-275216 filed in Japan on Oct. 6, 2006, 2006-278818 filed in Japan on Oct. 12, 2006 and 2006-278828 filed in Japan on Oct. 12, 2006.

BACKGROUND OF THE INVENTION

1. Field of the Invention

The present invention relates to an image forming apparatus and a process cartridge.

2. Description of the Related Art

In electrophotographic image forming apparatuses, an image is formed by subjecting a photoconductor used as an image carrier to a charging process, an exposure process, a developing process, and a transfer process.

Electrical discharge products produced in the charging process and non-transferred toner that is not transferred to a transfer material sometimes remain on the photoconductor. Therefore, a cleaning process is performed on the photoconductor after the transfer process to remove the electrical discharge products and remaining toner from the photoconductor.

As a cleaning system used in the cleaning process, a system using a rubber blade is generally well known. The rubber blade is inexpensive, simple in mechanism, and excellent in cleaning capability.

However, because the rubber blade is used to remove residual materials from the surface of the photoconductor by being pressed against it, there is large stress due to friction between the surface of the photoconductor and a cleaning blade as the rubber blade. Therefore, the rubber blade is worn, and the surface layer of the photoconductor or of an organic photoconductor in particular is worn, which causes both lives of the rubber blade and the organic photoconductor to be reduced.

Recently, small-sized toner particles are increasingly used for image formation to meet demands for high image quality.

In the image forming apparatus using the small-sized toner particles, residual toner particles as non-transfer toner quite often pass through under the cleaning blade. Particularly, when dimensional accuracy of the cleaning blade or the assembly accuracy are insufficient or when the cleaning blade partly vibrates, much more of the toner particles pass through under the cleaning blade, which prevents formation of high-quality images.

Therefore, to extend the life of the organic photoconductor and maintain high image quality over a long period, it is necessary to reduce degradation of a material due to friction and improve the cleaning capability.

One of general methods of reducing friction is a method of supplying a lubricant to the surface of the photoconductor, making the supplied lubricant uniform by the cleaning blade, and forming lubricant coating thereon.

When the lubricant is used, and if an applied amount of the lubricant is too little, then the lubricant is not much effective in wear and flaws of the image carrier or in degradation of the blade. If the lubricant is applied too much, then excessive lubricant is accumulated on the photoconductor to cause "flowing" of an image, or the excessive lubricant may be mixed into a developer to cause performance of the developer to decrease. Thus, it is necessary to define the supplied amount of lubricant.

A configuration of controlling the supplied amount of lubricant is proposed in Japanese Patent Application Laid-Open No. 2000-75752.

Japanese Patent Application Laid-Open No. 2000-75752 discloses that the charging system is contact charging, a tandem machine is provided by arranging imaging units in line that create individual images of a plurality of colors, and that the lubricant is applied at least 0.4 gram or more by the time when a driving distance of the photoconductor reaches 525 meters which corresponds to about 1250 sheets of paper of A3 in vertical orientation. This image forming apparatus is excellent in specific image formation based on such a condition that contents of an image to be formed i.e. toner consumption or the like is almost constant.

Recently, on the other hand, so-called alternating current (AC) charging tends to be used for the charging process. The AC charging is performed by using a charging roller or the like that is charged by superimposing an AC voltage on a direct current (DC) voltage.

The AC charging has excellent capabilities such as high uniformity of a charging potential on a photoconductor, less generation of oxidized gas such as ozone and NOx, and minimization of a device. On the other hand, the AC charging has disadvantages such that positive/negative electrical discharge is repeated hundreds to thousands times per second between a charging element and a photoconductor according to frequencies of a DC voltage to be applied, which causes degradation of the surface layer of the photoconductor due to a large number of electrical discharges, to be accelerated.

As a method of suppressing progress of the degradation on the surface layer of the photoconductor, a method of applying a lubricant such as zinc stearate to the surface layer and executing the charging process is proposed in Japanese Patent Application Laid-Open No. 2005-17469.

The content disclosed in Japanese Patent Application Laid-Open No. 2000-75752 shows that although it is effective in specific image formation in which an image forming condition such as toner consumption or the like is uniform, it is ineffective in formation of various types of images such that failure frequently occurs in an initial stage particularly when the photoconductor is started. Furthermore, even if the consumption is made to be constant, the property of the cleaning capability changes depending on each production lot of lubricants.

On the other hand, the following problems arise in the method of executing the charging process after the lubricant is applied, as disclosed in Japanese Patent Application Laid-Open No. 2005-17469.

When the lubricant is applied on the photoconductor, the energy of the AC charging is first adsorbed by the lubricant and thus the energy is difficult to reach the surface of the photoconductor, which allows protection of the surface thereof by suppressing the degradation due to AC charging.

However, if AC charging is performed in such a manner that the AC voltage is superimposed on the DC voltage based on such a configuration that a charging roller is provided close to the photoconductor, the coating of the lubricant formed on the surface of the photoconductor disappears by being applied with the AC charging.

A disappearing speed is extremely fast as compared with that of corona discharging, and thus how to form lubricant coating is largely different from that of the corona discharging.

If a unit of applying the lubricant while AC charging is continued and image formation is also continued is used, the phenomenon in which degradation of the surface of the photoconductor is progressing caused by the AC charging occurs more quickly than the effect that the lubricant is applied to the surface thereof and the coating is formed to thereby protect the photoconductor, depending on an applied amount of lubricant.

If the applied amount of lubricant is increased to avoid this problem, some problems such as blurring or a change in property of a developer arises. On the other hand, if the applied amount of lubricant is suppressed and a sufficient amount of lubricant is not thereby uniformly applied over the surface thereof, then the degradation of the surface thereof is accelerated by being applied with AC charging.

Although Japanese Patent Application Laid-Open No. 2005-17469 discloses a technology on protection of the surface of the photoconductor with the lubricant, it does not teach or suggest influences on an image and further on the cleaning capability due to behavior of the lubricant upon charging after the lubricant is applied as explained above. Therefore, the problem on how the lubricant affects the cleaning capability including disappearance of the lubricant remains unsolved.

As disclosed in Japanese Patent Application Laid-Open No. 2005-17469, the lubricant, zinc stearate in particular, applied to the surface of the photoconductor sometimes exists in a form of powder or mass. In this case, the surface of the photoconductor becomes nonuniform depending on whether the lubricant is deposited. Therefore, when the deposited lubricant being the powder or mass as it is passes through the charging process, the coat on a certain portion of the surface where the lubricant is deposited is not scraped. However, a portion on the surface where no lubricant is deposited is not protected with the lubricant, which causes the coat of the surface layer to be scraped. Based on this situation, image formation is performed under actual use conditions, defects such as streaks appear on the image due to irregular wear affected by toner input and an image area or a non-image area.

Furthermore, if powder or mass of the lubricant is present on the photoconductor, the powder or the mass flies or moves onto the charging roller when passing through the charging roller, and melts thereon. The melted powder or the mass is solidified with toner components such as external additives of toner. The resistance becomes high at portions where the lubricant has locally melted and solidified, which may cause uneven charging.

A detailed study is conducted on the state condition of zinc stearate in an initial state or a state after time passes when the AC voltage is applied using a proximity charging method. There is sometime a case where a portion on the surface of the photoconductor is unevenly applied with the lubricant upon start of the photoconductor. As for the portion with the lubricant deposited thereon, when the portion where the lubricant has once been formed is subjected to AC charging, the coating of the lubricant disappears, but the coating is formed again by again applying the lubricant to the surface thereof.

On the other hand, according to experiments conducted by the inventors of the present invention, it is found that if the portion of the surface where no lubricant is deposited due to uneven charging is once degraded by being subjected to AC charging, and even if the lubricant is applied to the degraded portion, the lubricant is difficult to be kept deposited thereon.

Consequently, in the position where AC charging is applied in the initial stage before the coating is formed, the lubricant cannot be retained and degradation of the portion is progressing with time, while in the portion where the coating of the lubricant is formed in the initial stage, the coating is newly formed by applying the lubricant and thus the degradation does not easily progress. It is, therefore, clear that if the lubricant is unevenly applied in the initial stage, this causes local degradation to progress.

According to the result, the method disclosed in Japanese Patent Application Laid-Open No. 2005-17469 may cause lubricant retention not to be ensured when the lubricant is unevenly applied or the time passes. It is confirmed through the experiments that this case is caused to degrade the photoconductor or not to keep high-quality images.

When the zinc stearate is used as the lubricant, to apply this material, a following method may sometimes be employed. The method is such that a brush is pressed against a bar of zinc stearate to make powder of zinc stearate, the powder thereof is made to drop on the photoconductor and be deposited thereon, and the powder thereof is crushed and spread out by a blade or the like.

To increase the amount of the zinc stearate on the photoconductor, it is generally thought of that the particle size of the zinc stearate to be applied to the photoconductor is increased or the number of particles is increased, and in many cases the force to press the brush against the bar of the zinc stearate is increased. However, when the AC charging by the charging roller is used in the charging process, as explained above, the following problem tends to arise. The problem is such that various substances are deposited on the charging roller and further these substances are firmly fixed thereto, which causes resistance of the charging roller to be locally increased, and defective charging is caused to occur in this local portion.

The powder of the zinc stearate generated by pressing the brush against the bar of the zinc stearate moves to the developer, in addition to movement of the powder to the charging roller. The chargeability of the developer thereby changes, which may cause failure in density reduction. As explained above, when the zinc stearate is applied to the photoconductor, because the above mentioned process is used, it is not possible to avoid that the powder of the zinc stearate moves to some places other than the photoconductor.

Because the lubricant existing on the photoconductor in mass or powder form moves to some places from the photoconductor, the following method can be used such that the lubricant applied to the photoconductor is present thereon in an or film form but not in mass or powder. Incidentally, the term "irregular" as used herein refers to a state that cannot be described as a specific form, i.e., a form that cannot be explained by indices such as a particle diameter or a degree of circularity.

The method is such that the lubricant is supplied to the photoconductor in the form of particles or mass, and is sufficiently spread out using a blade or so. However, there is a limit to spread out the lubricant supplied in the form of particles or mass and there is a slight space between the blade and the photoconductor, and therefore, the powder passes through the space. If the blade is pressed more strongly against the photoconductor to prevent passage of the powder of the lubricant, then wear of the photoconductor is accelerated. As explained above, if the lubricant is supplied to the photoconductor in the form of mass or particles, the mass or the particles cannot perfectly be removed.

When the powder of bar of the lubricant is supplied to the photoconductor by using the brush, there is no particular problem in the short term. However, when it is used over the long term, the powder of the lubricant on the photoconductor moves to some places other than the photoconductor. The movement causes change in property of the developer or defective charging of the charging roller to occur, and thus high-quality image formation cannot be maintained over the long term.

Japanese Patent Kokoku Publication No. S51-22380 and Japanese Patent Application Laid-Open No. 2004-333961 have proposed a technology of applying solid lubricant containing zinc stearate as a main component to the surface of the photoconductor and forming lubricant coating on the surface thereof to extend the lives of the photoconductor and the cleaning blade.

In the conventional technology, when zinc stearate is used as a solid lubricant, a protective-agent bar made of zinc stearate is pressed by a brush and the zinc stearate is shifted to the brush, and the zinc stearate is supplied from the brush to the surface of the photoconductor. Because the zinc stearate is comparatively hard, when the brush is pressed against it, the zinc stearate is made powder and the powder is deposited on the surface thereof. By spreading the powder using the blade or the like, the zinc stearate is formed on the photoconductor in film form.

However, part of the powdery zinc stearate deposited on the photoconductor keeps its powdery form even when it passes through under the cleaning blade, and thus, the powdery zinc stearate is easily deposited on a charger in the charging process. Particularly, when the charging roller is used for the charger, the photoconductor and the charging roller are in contact with each other or have only a distance of hundreds micrometers or less between the two. Therefore, there is extremely high probability in which particles of zinc stearate are deposited on the charging roller. These methods have further disadvantages such that when the DC voltage is superimposed on the AC voltage to be charged to the charging roller, the zinc stearate deposited on the charging roller melts thereon by charging energy, the melted material is firmly fixed to the charging roller in film form while involving toner components remaining on the surface of the photoconductor after being cleaned, which causes the resistance in the portion with melted material fixed thereon to increase, and thus uneven charging easily occurs. Therefore, a lubricant (protective agent) that does not become easily a fine powder even if the brush is pressed against it is required.

When a protective-agent bar formed of a bar-type protective agent is pressed by the brush to supply the protective agent to the photoconductor, the following measure is found effective to cause the protective-agent bar to hardly become the fine powder. The effective measure is such that a soft material is used for the protective agent and the protective-agent bar is not made powder caused by impact occurring when the brush is pressed against the protective-agent bar, but the protective agent is deposited on the end of the brush, and when the end of the brush with the protective agent deposited thereon is brought into contact with the photoconductor, the protective agent shifts from the brush to the photoconductor.

However, in an initial stage in which the protective agent is to be deposited, the protective agent is not deposited on the brush, and thus the protective agent is difficult to be supplied to the photoconductor. If image formation is repeated when the protective agent is not on the photoconductor, then a portion without the protective agent is oxidized and degraded due to energy of charging. The oxidation and degradation cause the cleaning capability of residual toner on the photoconductor to be decreased, the edge of the cleaning blade to be worn, and so-called filming that toner components are deposited in film form to easily occur. If these phenomena once occur, defects are hardly resolved even if the protective agent can be supplied again, which results in replacement of the photoconductor or the process cartridge.

SUMMARY OF THE INVENTION

It is an object of the present invention to at least partially solve the problems in the conventional technology.

According to an aspect of the present invention, an image forming apparatus includes an image carrier; a charging unit that uniformly charges the image carrier; a developing unit that develops an electrostatic latent image formed on the image carrier to obtain a toner image as a visual image; a transfer unit that transfers the toner image onto a transfer material; a cleaning unit that removes toner remaining on the image carrier; a protective-agent bar that contains an protective agent; and a protective-agent supplying unit that includes a brush that rotates to supply the protective agent to the image carrier. The brush is configured to be in contact with the protective-agent bar and the image carrier such that the protective agent adheres to the brush in an irregular form, and is supplied to a surface of the image carrier in an irregular form.

According to another aspect of the present invention, a process cartridge includes therein at least one of an image carrier that carries an electrostatic latent image; a protective-layer forming unit that supplies a protective agent to a surface of the image carrier to protect the surface; a charging unit that charges the image carrier; a developing unit that develops the electrostatic latent image on the image carrier to obtain a toner image as a visual image; a transfer unit that transfers the toner image onto a transfer material; and a cleaning unit that removes toner remaining on the image carrier.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
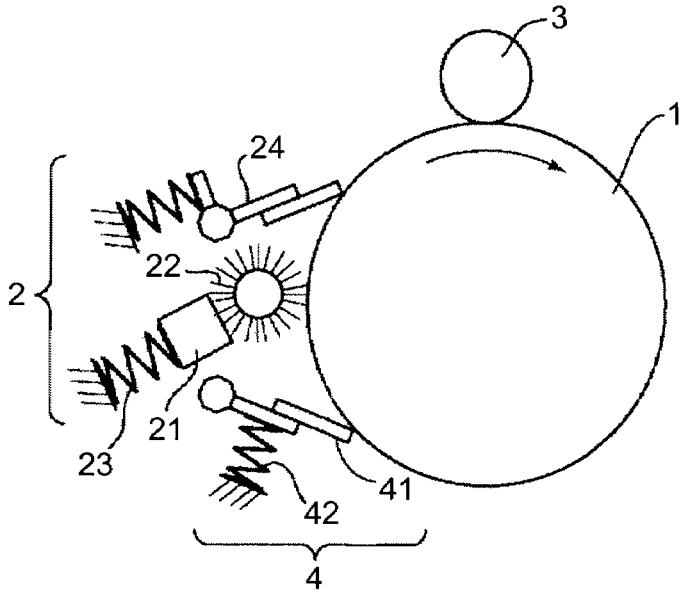
FIG. 1 is a schematic diagram of a protective-layer forming device according to a first embodiment of the present invention.

FIG. 1 is a schematic diagram of a protective-layer forming device 2 according to a first embodiment of the present invention.

The protective-layer forming device 2 is arranged opposite to a drum-type photoconductor 1 which is an image carrier. The protective-layer forming device 2 includes a protective-agent bar 21, a protective-agent supplying element 22, a pressing mechanism 23, and a protective-layer forming mechanism 24.

The protective-agent bar 21 is a block-shaped bar, and comes in contact with the brush-shaped protective-agent supplying element 22 by pressing force from the pressing mechanism 23.

The protective-agent supplying element 22 rotates with the rotation of the photoconductor 1 based on a difference in the linear velocity between the two and slidably contacts the photoconductor 1. During the contact, a protective agent held on the surface of the protective-agent supplying element 22 is supplied to the surface of the image carrier.

Specifically, the protective-agent supplying element 22 pressed onto the protective-agent bar 21 neither generates lubricant particles by scraping lubricant off the protective-agent bar 21 with the brush nor supplies the particles to the photoconductor 1. The protective-agent supplying element 22 brings the brush into contact with the protective-agent bar 21 such that the lubricant adheres to the brush in an irregular form and is supplied to the surface of the photoconductor 1 from the rotating brush. Thus, the lubricant is held on the photoconductor 1 essentially in an irregular form. This prevents the lubricant from moving to other portions than the photoconductor 1 as well as mixing into a developer. This also prevents substances adhered to a charging roller from solidifying and being fixed thereto, which results in preventing charging failure.

Figure 7A:
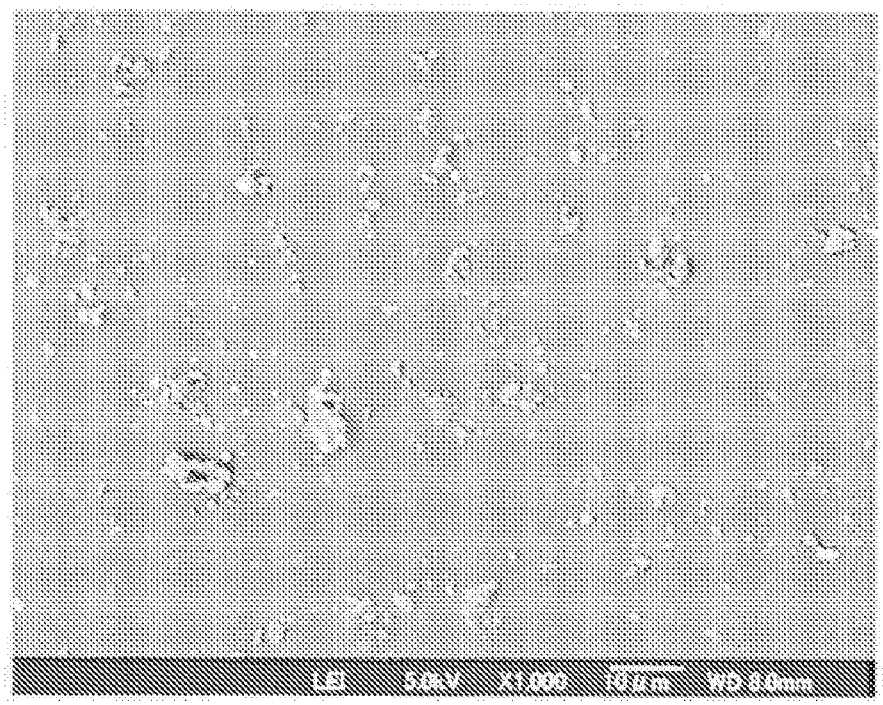
FIGS. 7A and 7B are schematic diagrams of scanning electron microscope (SEM) images for comparing the cases where lubricant is supplied in an irregular form and particle form.
Figure 7B:
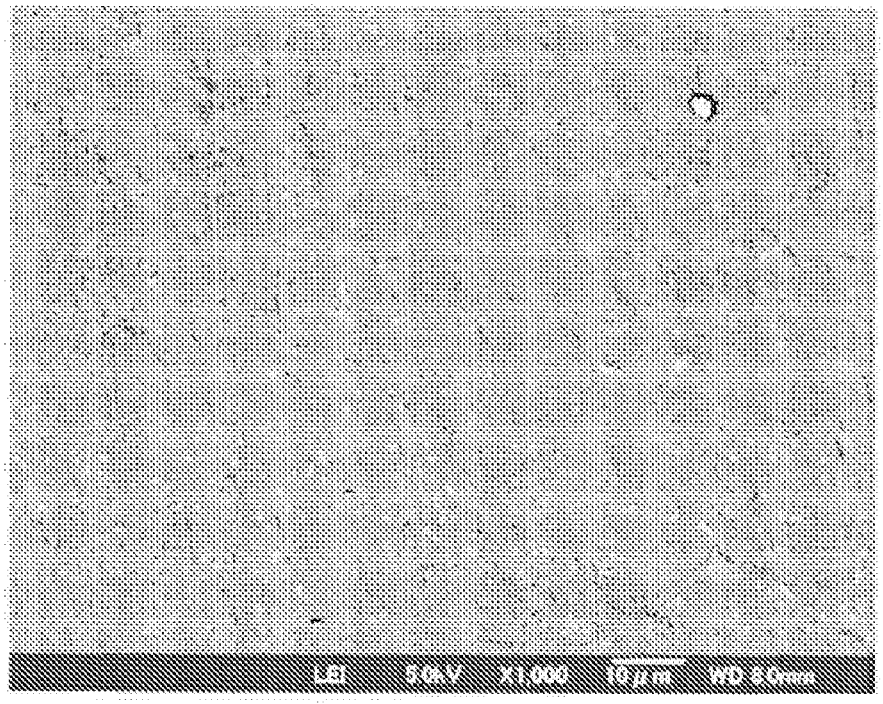

As described above, the term "irregular" as used herein refers to a state that cannot be described as a specific form. FIGS. 7A and 7B are schematic diagrams of scanning electron microscope (SEM) images for comparing the cases where lubricant is supplied in an irregular form and particle form. In the conventional technologies, a brush is pressed onto a protective-agent bar to generate lubricant particles to be supplied to a photoconductor. In this case, the lubricant particles has specific forms that can be explained by indices such as a particle diameter or a degree of circularity as shown in FIG. 7A. On the other hand, according to the first embodiment, lubricant is not in a specific form differently from the particles as shown in FIG. 7B, and thus, explained as being irregular.

The protective agent supplied to the surface of the photoconductor 1 is not often formed as an adequate protective layer upon supply depending on selection of material types. Therefore, to form more uniform protective layer, the protective agent on the surface of the photoconductor is formed as a thin film by the protective-layer forming mechanism that includes a blade-type element, and the protective agent becomes a protective layer on the surface of the image carrier.

The photoconductor 1 which is an image carrier with the protective layer formed thereon is in contact with or close to a charging roller (charger 3) to which an AC voltage or a voltage obtained by superimposing an AC voltage thereon is applied by a high-voltage power supply (not shown). The image carrier is charged by electrical discharge in a fine space between the two. In this case, part of the protective layer is decomposed or oxidized due to electrical stress, or products due to aerial discharge are deposited on the surface of the protective layer. The products due to decomposition, the oxide, and the products due to aerial discharge are generally hydrophilic or contain a hydrophilic group.

The protective agent contains an amphiphilic organic compound (B) having a hydrophilic portion and a hydrophobic portion in one molecule, as composition thereof. The protective agent also contains a hydrophobic organic compound (A) as one composition. Therefore, the amphiphilic organic compound (B) is adsorbed to the portion which becomes hydrophilic due to the electrical stress on the surface of the image carrier. The adsorption makes the surface hydrophobic, and it is also prevented to directly apply the electrical stress to the surface of the image carrier by the presence of the hydrophobic organic compound (A) around the portion.

Part of the protective agent is degraded due to the electrical stress instead, and becomes partly hydrophilic. However, the hydrophilic part is formed in the reverse micelle with redundantly existing amphiphilic organic compounds (B) having an appropriate hydrophile-lipophile balance (HLB) value, and is dispersed in the hydrophobic organic compound (A). Therefore, it is possible to balance the protection effect of the image carrier by the protective layer and the removal capability of a degraded protective agent from the image carrier.

The HLB value in this case is obtained by the following formula which is so-called Kawakami's method.

$$HLB=7+11.7\log(Mw/Mo)$$

where Mw is a molecular weight of a hydrophilic portion, Mo is a molecular weight of a lipophilic group, and log is a common logarithm.

It is important for the amphiphilic organic matter to have both a function of adsorbing the matter to the surface of the image carrier and a surface hydrophobizing function by taking in a component to degrade a protective agent. It is important to set an HLB value so that the amphiphilic organic compound (B) is formed in the reverse micelle with the protective agent which is degraded due to the electrical stress. It is preferable to set this value to a range of 1.0 to 6.5 because the setting allows the matter to be appropriately stable with respect to humidity.

The amphiphilic organic compound (B) in the image carrier is preferably a nonionic surfactant.

The amphiphilic organic compound is classified into an anionic surfactant, a cationic surfactant, a zwitterionic surfactant, a nonionic surfactant, and a compound thereof. The protective agent is required to prevent a bad influence from being exerted upon the electrical property of the image carrier to form the protective agent on the image carrier and perform an imaging process.

When the nonionic surfactant is used as the amphiphilic organic compound, there is no ionic dissociation in the surfactant itself. Therefore, even if the use environment, particularly, humidity largely changes, charge leakage due to aerial discharge can be suppressed, and high image quality can be maintained. Furthermore, the nonionic surfactant is preferably an esterified product of an alkyl carboxylic acid and a polyalcohol group based on Formula (1) as follows:

[Formula 1]

$$C_nH_{2n+1}COOH \quad (1)$$

where n is an integer of 15 to 35.

By using a straight-chain alkyl carboxylic acid as an alkyl carboxylic acid of Formula (1), a hydrophobic portion of the amphiphilic organic compound is easily arrayed on the surface of the image carrier where the amphiphilic organic compound is adsorbed, and the adsorption density to the surface of the image carrier particularly increases, which is a preferable mode.

Alkyl carboxylate in one molecule shows hydrophobic property. If there is a larger number of alkyl carboxylates, it is more effective to prevent adsorption of a dissociated substance produced due to aerial discharge to the surface of the image carrier and to reduce the electrical stress to the surface of the image carrier in a charging area. However, if a proportion of the alkyl carboxylates occupied therein is too much, the portion of a polyalcohol group indicating hydrophilic property is hidden, and sufficient adsorption capability does not sometimes come out depending on the surface state of the image carrier.

Therefore, the average number of ester bonds per molecule of the amphiphilic organic compound is preferably in a range of 1 to 3.

The average number of ester bonds per molecule of the amphiphilic organic compound can be also adjusted by selecting at least one type from a plurality of amphiphilic organic compounds having different number of ester bonds and combining the selected ones.

As explained above, examples of the amphiphilic organic compound include an anionic surfactant, a cationic surfactant, a zwitterionic surfactant, and a nonionic surfactant.

Examples of the anionic surfactant includes compounds containing anion at the end of a hydrophobic portion such as alkylbenzene sulfonate, α-olefin sulfonate, alkane sulfonate, alkyl sulfate, alkyl polyoxyethylene sulfate, alkyl phosphate, long-chain fatty acid salt, α-sulfo fatty acid ester salt, and alkyl ether sulfate; and bonding the anion to alkali metal ion such as natrium and kalium, alkali earth metal ion such as magnesium and calcium, metal ion such as aluminum and zinc, and ammonium ion.

Examples of the cationic surfactant include compounds containing cation at the end of a hydrophobic portion such as alkyltrimethyl ammonium salt, dialkyldimethyl ammonium salt, and alkyldimethyl benzyl ammonium salt; and boding the cation to chlorine, fluorine, bromine, phosphate ion, nitrate ion, sulfate ion, thiosulfate ion, carbonate ion, and hydroxy ion.

Examples of the zwitterionic surfactant include dimethylalkylamine oxide, N-alkylbetaine, imidazoline derivative, and alkyl amino acid.

Examples of the nonionic surfactant include alcohol compounds, ether compounds, and amido compounds such as long-chain alkyl alcohol, alkyl polyoxyethylene ether, polyoxyethylene alkyl phenyl ether, fatty acid diethanol amide, alkyl polyglucoxide, and polyoxyethylene sorbitan alkyl ester. Preferred examples thereof are long-chain alkyl carboxylic acid such as lauric acid, palmitic acid, stearic acid, behenic acid, lignoceric acid, cerotic acid, montan acid, and melissic acid; a polyalcohol group such as ethylene glycol, propylene glycol, glycerin, erythritol, and hexitol; and ester compounds of any of these and a partial anhydride.

More specific examples of the ester compounds include glyceryl alkylcarboxylate such as glyceryl monostearate, glyceryl distearate, glyceryl monopalmitate, glyceryl dilaurate, glyceryl trilaurate, glyceryl dipalmitate, glyceryl tripalmitate, glyceryl dimyristate, glyceryl trimyristate, glyceryl palmitate stearate, glyceryl monoarachidate, glyceryl diarachidate, glyceryl monobehenate, glyceryl stearate behenate, glyceryl cerotate stearate, glyceryl monomontanate, and glyceryl monomelissate, and substituted compounds thereof, sorbitan alkylcarboxylate such as sorbitan monostearate, sorbitan tristearate, sorbitan dipalmitate, sorbitan tripalmitate, sorbitan dimyristate, sorbitan trimyristate, sorbitan palmitate stearate, sorbitan monoarachidate, sorbitan monobehenate, sorbitan stearate behenate, sorbitan scerotate stearate, sorbitan monomontanate, and sorbitan monomelissate, and substituted compounds thereof, but the ester compounds are not limited thereto.

A single or a plurality kinds of these amphiphilic organic compounds may be used.

In addition to the amphiphilic organic compound, a hydrophobic organic matter is preferably mixed in the protective agent. By mixing the hydrophobic organic matter therein, the protective-agent bar is made flexible, and the amphiphilic organic matter is thereby easier to be deposited to the entire surface of the image carrier. The hydrophobic organic matter is usually soft, and the protective-agent bar can thereby be kept to be softer than 5B in pencil hardness. Therefore, even if the brush is pressed against the protective-agent bar, the particles of the protective agent are hardly generated, and it is desirable that the protective agent can easily shift to the end of the brush.

The content of the hydrophobic organic matter in the protective agent used for the image forming apparatus is in a range of 10 wt % to 97 wt %, and preferably 20 wt % to 90 wt %. If the content of the hydrophobic organic matter is 10 wt % or less, it is not preferred because the protective-agent bar becomes fragile and when the brush is pressed against the protective-agent bar, a large number of particles easily come out from the protective agent, and the protective agent is not easily deposited in film form on the entire surface of the photoconductor. If the content of the hydrophobic organic matter is 97 wt % or more, it is not preferred because frictional force between the image carrier and the cleaning blade increases. Moreover, it is not preferred that the hydrophobic organic matter is oxidized and decomposed by the energy of the charging to become an ionic conductive material and this material often causes a latent image to blur. However, if the protective agent contains 3 wt % or more of amphiphilic organic matter therein, even if the hydrophobic organic matter is oxidized and decomposed to be the ionic conductive material, the amphiphilic organic matter involves the ionic conductive material to prevent the conductive properties from being imparted to the image carrier. Thus, occurrence of blurring largely decreases.

The molecular weight of the hydrophobic organic matter in the protective agent used in the image forming apparatus is preferably 350 to 850 based on the weight-average molecular weight Mw, and more preferably 400 to 800.

Specific examples of the hydrophobic organic compound include a hydrocarbon group which is classified into aliphatic saturated hydrocarbon, aliphatic unsaturated hydrocarbon, alicyclic saturated hydrocarbon, alicyclic unsaturated hydrocarbon, and aromatic hydrocarbon. In addition to the hydrocarbon group, the examples also include fluororesin and fluoro wax group such as polytetrafluoroethylene (PTFE), polyperfluoroalkylether (PFA), perfluoroethylene-perfluoropropylene copolymer (FEP), polyvinylidene fluoride (PVdF), ethylene-tetrafluoroethylene copolymer (ETFE); and silicone resin and a silicone wax group such as polymethylsilicone and polymethylphenylsilicone. However, the hydrophobic organic compound is not limited by these materials. Particularly, the aliphatic saturated hydrocarbon is extremely preferable because it has high compatibility with the amphiphilic organic compound, the amphiphilic organic compound can thereby be deposited in film form on the entire surface of the image carrier, and is economically inexpensive.

Conventionally, the aliphatic saturated hydrocarbon is contained in toner, and deposition of the aliphatic saturated hydrocarbon on the photoconductor is called "wax filming", which causes defective images. Thus, measures against this problem have been taken so as not to cause the aliphatic saturated hydrocarbon to be deposited on the photoconductor.

However, using the aliphatic saturated hydrocarbon mixed with the amphiphilic organic compound, and this does not cause defective images even if the aliphatic saturated hydrocarbon is deposited on the photoconductor while a defect of the amphiphilic organic compound which is quite difficult to be spread out is compensated. This is a new discovery.

The aliphatic saturated hydrocarbon and the alicyclic saturated hydrocarbon are preferred as the aliphatic saturated hydrocarbon because intramolecular bonding is formed only with saturated bonding in which reactivity is low and stable. Among them, normal paraffin, isoparaffin, and cycloparaffin are chemically stable because an addition reaction is difficult to occur, and cause an oxidation reaction to be difficult to occur in atmosphere in actual use. Thus, these materials are preferably used in view of stability over time.

Furthermore, the hydrophobic organic compound contains normal paraffin, and this is more preferable because this compound has a smooth mutual action with the lipophilic portion in the amphiphilic organic compound (B), so that a protective-agent layer formed on the surface of the image carrier can be used while being refreshed, and thus, degraded substances existing in the form of the reverse micelle in the protective agent can be reliably removed.

As explained above, the protective-agent layer is exposed to electrical stress and degraded, and thus, if the molecular weight of the hydrophobic organic compound (A) is too small, protective effect cannot sometimes be exhibited adequately.

On the other hand, if the molecular weight of the hydrophobic organic compound (A) is too large, sufficient spreading capability cannot be obtained upon formation of the protective-agent layer, and the components of the protective agent on the image carrier become particulate to be deposited thereon, so that the components do not sometimes form a coated layer. In this state, the hydrophobic organic compound (A) is not much dedicated to protection of the image carrier, and the image carrier is protected largely by the amphiphilic organic compound (B) adsorbed to the surface thereof.

The molecular weight of the hydrophobic organic compound (A) is preferably 350 to 850 based on a weight-average molecular weight Mw, and more preferably 400 to 800.

If a complete solid solution is formed between the hydrophobic organic compound (A) and the amphiphilic organic compound (B) in the protective-agent bar, degraded components of the protective agent are sometimes difficult to be taken in the amphiphilic organic compound (B). Thus, it is preferable that the hydrophobic organic compound (A) and the amphiphilic organic compound (B) are in a state where one of the them is dispersed in the other one or in a state where the two are partly solid-soluted. This state can be implemented in a well-controlled manner by setting a difference in endothermic peak temperatures of the hydrophobic organic compound (A) and of the amphiphilic organic compound (B) and by providing a difference in temperatures to be solidified. Therefore, the protective agent preferably has at least each one endothermic peak temperature in a range of 40° C. to 70° C. and a range of 80° C. to 130° C.

If the bonding of the end portion of a protective-agent molecule is cut and degraded, the end portion has a low molecular weight. Therefore, the end portion is evaporated due to the energy of a charging area, and most of the portion is discharged to outside of the imaging system by the airflow. Components of which molecular weight is comparatively large and which are shrunk at the temperatures of the ambient elements, of the evaporated and degraded components of the protective agent, are sometimes deposited or adsorbed to the charging element or the like. These components with low molecular weight are easily decomposed during subsequently performed charging process, and discharged to the outside of the image forming system similarly to other components with low molecular weight. Therefore, accumulation thereof on the ambient elements with time hardly occurs.

Therefore, by using the protective agent, such failures can be avoided that lubricant components containing a metal element are decomposed and oxidized to become a metal oxide, and the metal oxide is accumulated on the charging element, which is thereby contaminated, and the contamination causes the charging element to be a high-resistance element.

The degraded protective agent is removed together with other components such as toner remaining on the image carrier by an ordinary cleaning mechanism. The cleaning mechanism can be shared with the protective-layer forming mechanism. However, the function of removing the residues on the surface of the image carrier is preferably separated from the function of forming the protective layer because elements appropriate for respective purposes have different sliding conditions. A cleaning mechanism or cleaning device 4 including a cleaning element 41 and a cleaning-element pressing mechanism 42 is preferably arranged on the upstream side of the protective-agent supplying element as shown in FIG. 1.

Materials of the blade used for the protective-layer forming mechanism are not particularly limited, and an elastic element generally known as a material for cleaning blade such as urethane rubber, hydrin rubber, silicone rubber, and fluoro rubber can be used singly or in a combination. These rubber blades may be subjected to coating or to a dipping process using any material with a low friction coefficient at a contact portion with the image carrier. To adjust the hardness of the elastic element, a filler such as any other organic filler or inorganic filler may be dispersed in the material.

Each of the blades is fixed to a blade support by using an arbitrary method such as bonding or fusion bonding so that the edge of the blade can be pressed to contact the surface of the image carrier. Although the thickness of the blade is not uniquely defined because it depends on a pressing force, if it is in a range of about 0.5 millimeter to 5 millimeters, the blade is preferably used, and if in a range of about 1 millimeter to 3 millimeters, then it can be more preferably used.

The length i.e. free length of the cleaning blade which protrudes from the blade support and allows deflection thereof is not also uniquely defined because it depends on the pressing force. However, if it is in a range of about 1 millimeter to 15 millimeters, the blade is preferably used, and if in a range of about 2 millimeters to 10 millimeters, then it can be more preferably used.

One of other configurations of the blade material for forming the protective agent is such that a layer of resin, rubber, or elastomer is formed on the surface of an elastic metal blade such as a spring plate via a coupling agent or a primer component if necessary by coating or dipping. The resultant blade is subjected to thermosetting if necessary, and further subjected to surface polishing as required.

If the thickness of the elastic metal blade is in a range of about 0.05 millimeter to 3 millimeters, the blade can be preferably used, and if in a range of about 0.1 millimeter to 1 millimeter, then it can be more preferably used.

To prevent torsion of the elastic metal blade, the blade may be subjected to a process such as bending in a direction substantially parallel to a spindle after being fixed.

As a material to form the surface layer, fluororesin such as PFA, PTFE, FEP, and PVdF; and a silicone base elastomer such as fluororubber and methylphenyl silicone elastomer can be used together with the filler if necessary, however, the material is not limited by these materials.

The force to press the image carrier by the protective-layer forming mechanism is only required as force with which the protective agent is spread to be formed as a protective layer or a protective film. Therefore, as a linear pressure, a range of 5 gf/cm to 80 gf/cm is preferable, and a range of 10 gf/cm to 60 gf/cm is more preferable.

A brush type material is preferably used as a protective-agent supplying element. However, in this case, to suppress mechanical stress to the surface of the image carrier, brush fibers preferably have flexibility.

As specific materials of the flexible brush fibers, one or more of types can be selected from among generally known materials. Specifically, any resin having flexibility of those as follows can be used: polyolefin resin such as polyethylene and polypropylene; polyvinyl and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; styrene-acrylic acid copolymer; styrene-butadiene resin; fluororesin such as polytetrafluoroethylene, polyvinyl fluoride, polyvinylidene fluoride, and polychloro-trifluoroethylene; polyester; nylon; acryl; rayon; polyurethane; polycarbonate; phenol resin; and amino resin such as urea-formaldehyde resin, melamine resin, benzoguanamine resin, urea resin, and polyamide resin. Furthermore, to adjust the degree of deflection, those as follows may be used in a combined manner: diene rubber, styrene-butadiene rubber (SBR), ethylene propylene rubber, isoprene rubber, nitrile rubber, urethane rubber, silicone rubber, hydrin rubber, and norbornen rubber.

The support of the protective-agent supplying element includes a fixed type and a rotatable roll type. One of roll-type supplying elements is a roll brush obtained by spirally winding a pile type tape made from brush fibers around a core metal. The brush fibers having those conditions as follows are preferably used. That is, the diameter of the brush fiber ranges from about 10 to 500 micrometers, the length thereof ranges from 1 to 15 millimeters, and the density thereof ranges from 10,000 to 300,000 lines per square inch ($1.5\times10^7$ to $4.5\times10^8$ lines per square meter).

As the protective-agent supplying element, it is preferable that a material with high brush density is used as possible as it can be, in terms of uniformity and stability when the protective agent is supplied. It is also preferable that one fiber is made from several to hundreds lines of fine fibers. For example, 50 fine fibers of 6.7 decitexes (6 deniers) are tied in a bundle, like 333 decitexes=6.7 decitexes×50 filaments (300 deniers=6 deniers×50 filaments), and the bundle as one fiber can be planted in the brush.

A coating layer may be formed on the surface of the brush to stabilize the shape of the surface and environmental stability of the brush as required. As a component to form the coating layer, it is preferable to use a coating layer component capable of deforming according to the deflection of the brush fibers. Any material can be used if it can keep flexibility. Examples thereof are polyolefin resin such as polyethylene, polypropylene, chlorinated polyethylene, and chlorosulfonated polyethylene; polyvinyl and polyvinylidene resin such as polystyrene and acryl such as polymethyl methacrylate, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; silicone resin of organosiloxane bonding or its modified product of such as alkyd resin, polyester resin, epoxy resin, and polyurethane; fluororesin such as perfluoroalkyl ether, polyvinyl fluoride, polyvinylidene fluoride, and polychloro-trifluoroethylene; polyamide; polyester; polyurethane; polycarbonate; and amino resin such as urea-formaldehyde resin; epoxy resin; and composite resin of these materials.

Figure 2:
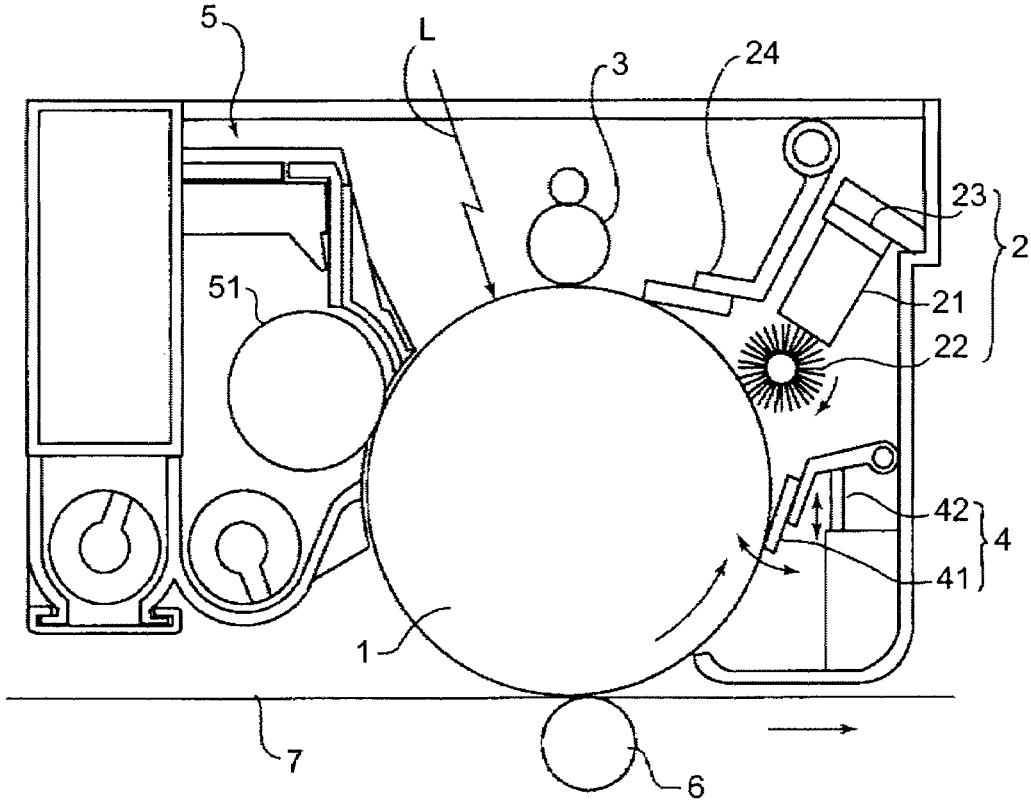
FIG. 2 is a schematic diagram of a process cartridge used in the protective-layer forming device.

FIG. 2 is a schematic diagram of a process cartridge used in the protective-layer forming device 2.

The protective-layer forming device 2 is arranged facing the photoconductor 1. The protective-layer forming device 2 includes the protective-agent bar 21, the protective-agent supplying element 22, the pressing mechanism 23, and the protective-layer forming mechanism 24.

The surface of the photoconductor 1 is where the protective agent and toner components partly degraded after the transfer process remain, but the residues on the surface are cleaned by the cleaning element 41.

As shown in FIG. 2, the cleaning element comes in contact with the surface at an angle so as to be contacted in the counter direction (leading type) with respect to the surface.

The residual toner and the degraded protective agent are removed from the surface of the photoconductor 1, the protective agent of the protective-agent bar 21 is applied to the surface of the photoconductor 1 from the protective-agent supplying element 22, and a film-like protective layer is formed thereon by the protective-layer forming mechanism 24. The protective agent has excellent adsorption capability. Therefore, if this protective agent is applied to a portion of the surface of the photoconductor 1 which becomes highly hydrophilic due to electrical stress, large electrical stress is temporarily applied to the portion. However, even if the surface of the photoconductor 1 thereby starts degradation, the adsorption of the protective agent allows prevention of the progress of degradation in the photoconductor 1.

An electrostatic latent image is formed on the photoconductor 1 with the protective agent formed thereon, through exposure using laser L after the photoconductor 1 is charged, the latent image is developed by a developing device 5 to be visualized, and the visualized image is transferred onto an intermediate transfer member 7 by a transfer device 6 as a transfer roller provided outside the process cartridge.

Figure 3:
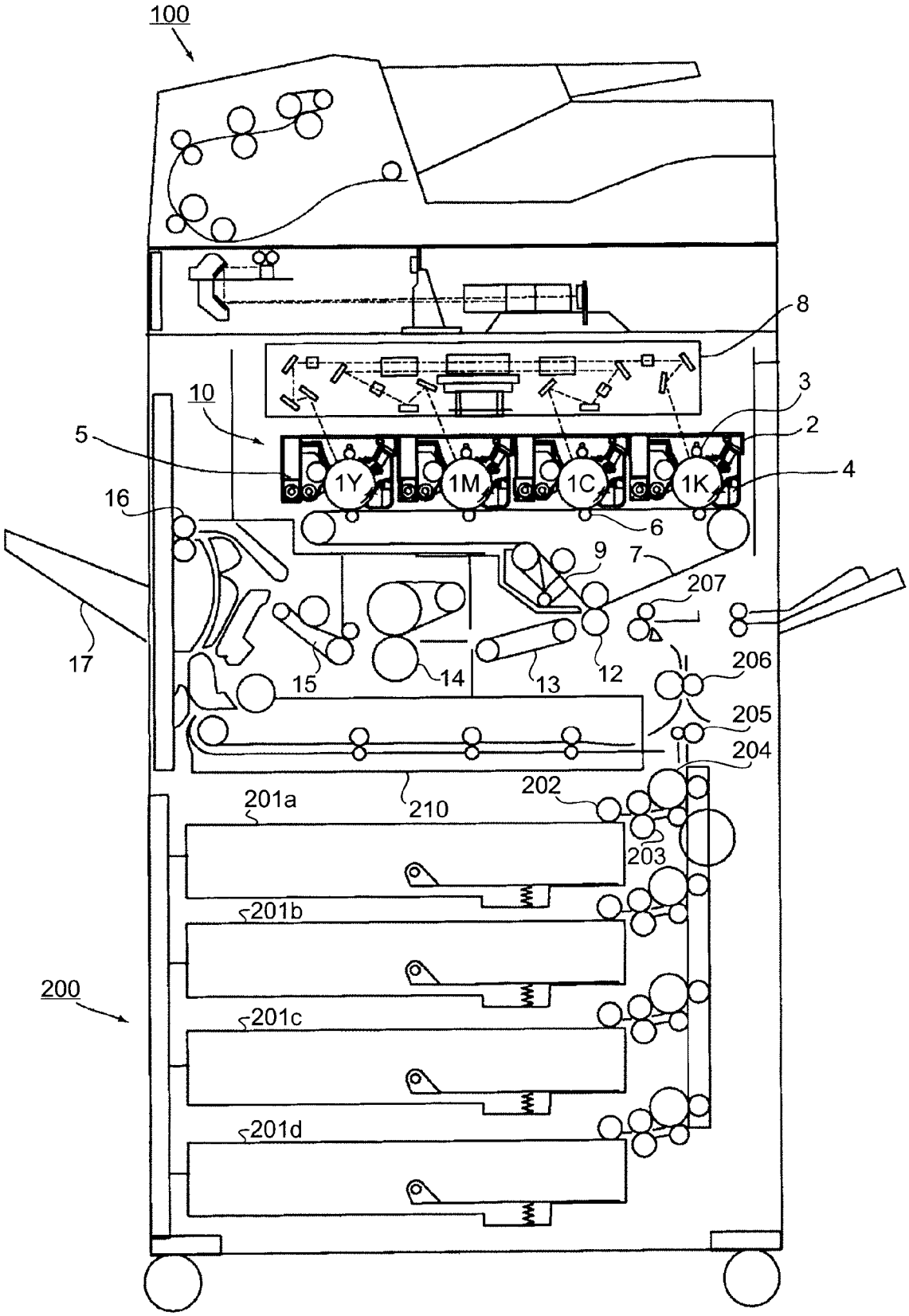
FIG. 3 is a schematic diagram of an image forming apparatus including the protective-layer forming device.

FIG. 3 is a schematic diagram of an image forming apparatus 100 including the protective-layer forming device 2.

Arranged around the drum-type photoconductor (image carrier) 1 (1Y, 1M, 1C, 1K) are the protective-layer forming device 2, the charger 3, a latent-image forming device 8, the developing device 5, the transfer device 6, and the cleaning device 4.

A series of processes for image formation are explained below using a negative-positive process.

The photoconductor 1 can be an organic photoconductor (OPC) having an organic photoconductive layer is decharged by a decharging lamp (not shown), and uniformly charged to negative by the charger 3 having a charging element.

When the photoconductor 1 is charged by the charger 3, a certain amount of voltage appropriate for charging of the photoconductor 1 to a desired potential or a charging voltage obtained by superimposing AC voltage on the voltage is applied from a voltage applying mechanism (not shown) to the charging element.

The charged photoconductor 1 is radiated with a laser beam emitted by the latent-image forming device 8 such as a laser optical system to form a latent image thereon (the absolute value of the potential at an exposed portion is lower than the absolute value of the potential at a non-exposed portion).

The laser beam is emitted from a semiconductor laser, and scans the surface of the photoconductor 1 in the direction of the rotating axis of the photoconductor 1 by a polygon mirror that rotates at high speed.

The latent image formed in the above manner is developed by a developer formed of toner particles supplied to a developing sleeve which is a developer carrier provided in the developing device 5 or formed of a mixture of toner particles and carrier particles, to form a visible image or a toner image.

When the latent image is to be developed, an appropriate amount of voltage or a developing bias obtained by superimposing AC voltage on the voltage is applied from the voltage applying mechanism (not shown) to the developing sleeve.

A toner image formed on the photoconductor 1 corresponding to each of colors is transferred to the intermediate transfer member 7 by the transfer device 6, and the toner image is transferred onto a transfer material fed from a sheet-feed mechanism 200.

At this time, as a transfer bias, a potential having a polarity opposite to that of charged toner is preferably applied to the transfer device 6. Thereafter, the intermediate transfer member 7 is separated from the photoconductor 1, to obtain a transferred image.

The toner particles remaining on the photoconductor 1 are collected by the cleaning element 41 into a toner collecting chamber in the cleaning device 4.

The image forming apparatus can include a plurality of developing devices to sequentially form a plurality of toner images of different colors by the developing devices. The toner images are sequentially transferred onto a transfer material, and sent to a fixing mechanism to be thermally fixed on the transfer material. The image forming apparatus can also include an intermediate transfer member onto which a plurality of toner images are temporarily and sequentially transferred. The toner images are then collectively transferred onto a transfer material, and fixed thereon in the above manner.

The charger 3 is preferably arranged in contact with or close to the surface of the photoconductor 1. With this feature, the amount of ozone produced upon charging can largely be suppressed as compared with a corona discharger called colotron or scolotron using an electrical-discharge wire.

However, in the charger that charges the charging element when it is in contact with or close to the surface of the photoconductor, electrical discharge is performed in an area close to the surface thereof as explained above, and thus electrical stress to the photoconductor tends to increase. By using the protective-layer forming device that uses the protective agent, the photoconductor can be maintained over the long period of time without degradation. Thus, it is possible to largely suppress variation of images over time or variation of images due to the use environment and ensure stable image quality.

The photoconductor used in the image forming apparatus has a photoconductive layer provided on a conductive support. The configuration of the photoconductive layer is a single layer type in which a charge generation material and a charge transport material are provided, a normal laminated type in which a charge transport layer is provided on a charge generation layer, or a reverse laminated type in which a charge generation layer is provided on a charge transport layer. A protective layer can also be provided on the photoconductive layer to improve mechanical strength, wear resistance, gas resistance, and cleaning performance of the photoconductor. An undercoat layer may also be provided between the photoconductive layer and the conductive support. Furthermore, a plasticizer, an antioxidant, and a leveling agent can also be added by an appropriate amount to each layer if necessary.

As the conductive support of the photoconductor, a conductive element having a volume resistivity of $10^{10}$ Ω·cm or less can be used. The conductive element includes one obtained by coating metal or a metal oxide on a film-like or cylindrical plastic or a sheet of paper by evaporation or spattering. More specifically, the metal includes aluminum, nickel, chrome, Nichrome, copper, gold, silver, and white gold; and the metal oxide includes tin oxide and indium oxide. The conductive element also includes a plate of aluminum, aluminum alloy, nickel, or stainless steel; and a tube obtained by forming a drum-shape element tube with any one of the plates using an extrusion or an extraction method, and subjecting the element tube to surface treatment such as cutting, finishing, and polishing.

Any drum-shape support as follows can be used: a diameter thereof is 20 millimeters to 150 millimeters, preferably 24 millimeters to 100 millimeters, and more preferably 28 millimeters to 70 millimeters. If the diameter thereof is 20 millimeters or less, it is not preferred because it is physically difficult to arrange processes such as charging, exposure, development, transfer, and cleaning around the drum. If the diameter is 150 millimeters or more, it is also not preferred because the size of the image forming apparatus increases. Particularly, a tandem type image forming apparatus needs to have a plurality of photoconductors, and for this reason, the diameter of each photoconductor is 70 millimeters or less, preferably 60 millimeters or less. An endless nickel belt or an endless stainless belt disclosed in Japanese Patent Application Laid-Open No. S52-36016 can also be used as the conductive support.

The undercoat layer of the photoconductor used in the image forming apparatus can be resin, or a material containing white pigment and resin as a main component, and a metal oxide film obtained by chemically or electro-chemically oxidizing the surface of a conductive base. The material containing white pigment and resin as a main component is preferable. Examples of the white pigment include metal oxides such as titanium oxide, aluminum oxide, zirconium oxide, and zinc oxide, and it is most preferable to contain the zinc oxide which is excellent in capability of preventing charge injection from a conductive substrate. Examples of resin used for the undercoat layer include thermoplastic resin such as polyamide, polyvinyl alcohol, casein, and methylcellulose; thermosetting resin such as acryl, phenol, melamine, alkyd, unsaturated polyester, and epoxy, and these can be used singly or as a mixture of two or more.

Examples of the charge generation material of the photoconductor used in the image forming apparatus include azo pigment such as monoazo pigment, bisazo pigment, trisazo pigment, and tetrakisazo pigment; organic pigments or dyes such as triallylmethane dyes, thiazine dyes, oxazine dyes, xanthene dyes, cyanine dyes, styryl pigment, pyrylium dyes, quinacridone pigment, indigo pigment, perylene pigment, polycyclic quinone pigment, bisbenzimidazol pigment, indanthrene pigment, squarylium pigment, and phthalocyanine pigment; inorganic materials such as selenium, selenium-arsonic, selenium-tellurium, cadmium sulfide, zinc oxide, titanium oxide, and irregular silicon, and these can be used singly or in combination of two or more.

The undercoat layer may be one layer or a plurality of layers.

Examples of the charge transport material of the photoconductor used in the image forming apparatus include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylene diamine derivatives, aminostilbene derivatives, and triphenylmethane derivatives, and these can be used singly or in combination of two or more.

A binder resin for use in formation of the photoconductive layer having the charge generation layer and the charge transport layer has electrical insulation property, and known resins with this property such as thermoplastic resin, thermosetting resin, light-curing resin, and photoconductive resin can be used. Examples of an appropriate binder resin include thermoplastic resin such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (metha)acrylic resin, polystyrene, polycarbonate, polyarylate, polysulphone, polyethersulphone, and ABC resin; thermosetting resin such as phenyl resin, epoxy resin, urethane resin, melamine resin, isocyanate resin, alkyd resin, silicone resin, thermosetting acrylic resin; and photoconductive resin such as polyvinyl carbazole, polyvinyl anthracene, and polyvinyl pyrene, and these can be used singly or as a mixture of two or more binder resins but the binder resin is not limited thereto.

As the antioxidant, for example, those as follows are used:

Monophenol Compounds 2,6-di-t-butyl-p-cresol, butylated hydroxyanisole, 2,6-di-t-butyl-4-ethyl phenol, stearyl-β-(3,5-di-t-butyl-4-hydroxyphenyl) propionate, and 3-t-butyl-4-hydroxynisole.

Bisphenol Compounds 2,2'-methylene-bis(4-methyl-6-t-butylphenol), 2,2'-methylene-bis(4-ethyl-6-t-butylphenol), 4,4'-thiobis(3-methyl-6-t-butylphenol), and 4,4'-butylidenebis(3-methyl-6-t-butylphenol).

High Molecular Phenol Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocophenol.

Paraphenylenediamine Group

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinone Group 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Sulfur Compounds

Dilauryl-3,3'-thiodipropionate, distearyl-3,3'-thiodipropionate, and ditetradecyl-3,3'-thiodipropionate.

Organic Phosphorus Compounds

Triphenylphosphine, tri(nonylphenyl)phosphine, tri(dinonylphenyl)phosphine, tricresylphosphine, and tri(2,4-dibutylphenoxy)phosphine.

As the plasticizer, an ordinary resin plasticizer such as dibutyl phthalate and dioctyl phthalate can be used as it is. The content of the plasticizer is preferably from about 0 to 30 parts by weight (wt. parts) per 100 wt. parts of the binder resin.

The leveling agent is allowed to be added to the charge transport layer. Examples of the leveling agent include silicone oils such as dimethyl silicone oils and methylphenyl silicone oils; and polymers or oligomers having a perfluoroalkyl group in their side chain. The content of the leveling agent in the charge transport layer is preferably from 0 to 1 wt. part per 100 wt. parts of the binder resin.

As explained above, the protective layer is provided to improve mechanical strength, wear resistance, gas resistance, and cleaning performance of the photoconductor.

An example of the surface layer includes a layer made of polymer with higher mechanical strength than that of the photoconductive layer, and a layer obtained by dispersing inorganic filler in the polymer. The polymer used for the surface layer may be either one of thermoplastic polymer and thermosetting polymer. However, the thermosetting polymer is more preferable because of its high mechanical strength and extremely high capability to suppress wear due to friction with the cleaning blade.

If the surface layer is thin in thickness, no trouble occurs even if it does not have charge transport capability. However, if the surface layer without charge transport capability is formed thick, then the thick surface layer easily causes reduction in sensitivity of the photoconductor, an increase in potential after exposure, and also an increase in residual potential. Therefore, it is preferred to cause the charge transport material to be contained in the surface layer or to use a material having the charge transport capability as polymer used for the protective layer.

Generally, the mechanical strength of the photoconductive layer is largely different from that of the surface layer. Consequently, if the protective layer is worn and removed due to friction with the cleaning blade, then the photoconductive layer starts wearing at once. Therefore, if the surface layer is provided, the surface layer is important to have an adequate thickness. The thickness is from 0.01 micrometer to 12 micrometers, preferably 1 micrometer to 10 micrometers, and more preferably 2 micrometers to 8 micrometers.

If the thickness of the surface layer is 0.1 micrometer or less, it is not preferred because the surface layer is too thin, part of the surface layer is easily removed due to friction with the cleaning blade, and the wear of the photoconductor progresses from the removed portion. If the thickness of the surface layer is 12 micrometer or more, then the thick surface layer easily causes reduction in sensitivity of the photoconductor, an increase in potential after exposure, and also an increase in residual potential. Particularly, if the polymer having the charge transport capability is used, it is also not preferred because the cost of the polymer having the charge transport capability is increased.

Desirable polymer used for the surface layer is transparent with respect to a write beam upon image formation, and excellent in insulation, mechanical strength, and adhesiveness. Examples of the polymer are ABS resin, ACS resin, olefin-vinyl monomer copolymer, chlorinated polyether, aryl resin, phenol resin, polyacetal, polyamide, polyamide-imide, polyacrylate, polyarylsulphone, polybutylene, polybutylene terephthalate, polycarbonate, polyethersulphone, polyethylene, polyethylene terephthalate, polyimide, acrylic resin, polymethylpentene, polypropylene, polyphenylenoxide, polysulphone, polystyrene, AS resin, butadiene-styrene copolymer, polyurethane, polyvinyl chloride, polyvinylidene chloride, and epoxy resin. These polymers may be thermoplastic polymers, but to enhance the mechanical strength of the polymer, the cross-link is made using a cross-linking agent having polyfunctional acryloyl group, carboxyl group, hydroxyl group, amino group, and the like, to obtain thermosetting polymer. The obtained thermosetting polymer allows increase in mechanical strength of the surface layer and large reduction in wear due to friction with the cleaning blade.

As explained above, it is preferable that the surface layer has the charge transport capability. To provide the charge transport capability to the surface layer, there are two methods: a method of using a mixture of the polymer used for the surface layer and the charge transport material, and a method of using the polymer having the charge transport capability for the surface layer. The latter one is preferred because the photoconductor highly sensitive and with less increase of potential after exposure and less increase of residual potential can be obtained.

An example of the polymer having the charge transport capability can be a group having the charge transport capability in the polymer expressed by Formula (2) as follows:

[Formula 2] (2)

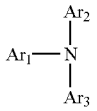

where $Ar_1$ represents substituted or unsubstituted arylene group. $Ar_2$ and $Ar_3$ represent individually substituted or unsubstituted aryl groups, and both of them can be the same as or different from each other.

The group having the charge transport capability is preferably added to the side chain of a polymer with the high mechanical strength such as polycarbonate resin and acrylic resin, and the acrylic resin is preferably used because it is easy to manufacture monomer and is excellent in coating capability and setting capability.

By polymerizing acrylic resin having the charge transport capability with unsaturated carboxylic acid having the groups in Formula (2), it is possible to form the surface layer having high mechanical strength and charge transport capability, and being excellent in transparency. By mixing the unsaturated carboxylic acid having the monofunctional groups in Formula (2) with polyfunctional unsaturated carboxylic acid, preferably 3 or more functional unsaturated carboxylic acid, the acrylic resin forms a cross-linked structure, which becomes thermosetting polymer. With these processes, the mechanical strength of the surface layer becomes extremely high. The groups in Formula (2) may be added to the polyfunctional unsaturated carboxylic acid. However, manufacturing cost of monomer increases, and thus, it is preferred not to add the groups in Formula (2) to the polyfunctional unsaturated carboxylic acid, but to use ordinary light-curable polyfunctional monomer instead.

Examples of monofunctional unsaturated carboxylic acid having the groups in Formula (2) are as shown in Formula (3) and Formula (4) as follows:

[Formula 3] (3)

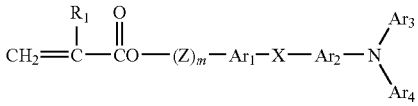

[Formula 4] (4)

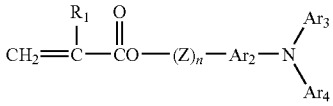

where $R_1$ represents a hydrogen atom, a halogen atom, an alkyl group which may have a substituted group, an aralkyl group which may have a substituted group, an aryl group which may have a substituted group; a cyano group, a nitro group; an alkoxy group, —$COOR_7$ ($R_7$ represents a hydrogen atom, an alkyl group which may have a substituted group, an aralkyl group which may have a substituted group, or an aryl group which may have a substituted group), a carbonyl halide group, or $CONR_8R_9$ ($R_8$ and $R_9$ represent a hydrogen atom, a halogen atom, an alkyl group which may have a substituted group, an aralkyl group which may have a substituted group, or an aryl group which may have a substituted group and both of them can be the same as or different from each other). $Ar_1$ and $Ar_2$ represent individually substituted or unsubstituted arylene groups and both of them can be the same as or different from each other. $Ar_3$ and $Ar_4$ represent individually substituted or unsubstituted aryl groups, and both of them can be the same as or different from each other. X represents a single bond, a substituted or unsubstituted alkylene group, a substituted or unsubstituted cycloalkylene group, a substituted or unsubstituted alkylene ether group, an oxygen atom, a sulfur atom, and a vinylene group. Z represents a substituted or unsubstituted alkylene group, a substituted or unsubstituted alkylene ether divalent group, and an alkylene oxycarbonyl divalent group. Each of m and n represents an integer of 0 to 3.

The proportion of the polyfunctional unsaturated carboxylic acid is 5 wt % to 75 wt % of the entire surface layer, preferably 10 wt % to 70 wt %, more preferably 20 wt % to 60 wt %. If the proportion of the polyfunctional unsaturated carboxylic acid is 5 wt % or less, it is not preferred because the mechanical strength of the surface layer is insufficient. If it is 75 wt % or more, it is also not preferred because the surface layer may easily be cracked when the strong force is applied thereto and sensitivity may easily be degraded.

When the acrylic resin is used for the surface layer, the surface layer can be formed by coating the unsaturated carboxylic acid to the photoconductor, and irradiating electron beams or active rays such as ultraviolet rays thereto to cause radical polymerization. When the radical polymerization is conducted by the active rays, a solution in which a photopolymerization initiator is dissolved in the unsaturated carboxylic acid. As the photopolymerization initiator, a material used for light-curable paint can be usually used.

To enhance the mechanical strength of the surface layer, fine particles of metal or metal oxide can be dispersed in the surface layer. Examples of metal oxide are titanium oxide, tin oxide, potassium titanate, TiO, TiN, zinc oxide, indium oxide, and antimony oxide. In addition to these materials, fluororesin such as polytetrafluoroethylene, silicone resin, and a material obtained by dispersing non-organic matter to any of these resins can be added to improve the wear resistance.

The photoconductor can be an intermediate transfer member used in an intermediate transfer system in which each toner image formed on a photoconductor is primarily transferred and superimposed on one after another, and the toner images are further transferred onto a transfer material.

The intermediate transfer member has preferably conductive properties of volume resistivity of $10^5$ Ω·cm to $10^{11}$ Ω·cm. If the surface resistivity is below $10^5$ Ω/square, an electrical discharge may be produced upon transfer of a toner image from the photoconductor onto the intermediate transfer member and so-called "transfer dust" may occur upon the transfer, and thus the toner image blurs due to the transfer dust. If it is above $10^{11}$ Ω/square, after the toner image is transferred from the intermediate transfer member onto a transfer material, the opposite charge to that of the toner image remains on the intermediate transfer member, and may appear on the next image as an afterimage.

A belt-shaped or cylindrical plastic can be used as the intermediate transfer member. The plastic is obtained by kneading singly or in combination of conductive particles, such as metal oxide including tin oxide and indium oxide and carbon black, or of conductive polymer with thermoplastic resin, and subjecting the kneaded materials to extrusion molding. In addition to this, an intermediate transfer member on an endless belt can also be obtained by adding the conductive particles or the conductive polymer to a resin solution containing monomers and oligomers having thermal crosslinking reactivity if necessary, and subjecting the mixed resin solution to centrifugal molding while being heated.

When the surface layer is to be provided on the intermediate transfer member, a conductive substance is used in combination of any required composition, other than the charge transport material, of the materials used for the surface layer of the photoconductor, and the resistivity thereof is controlled. Thus, the obtained conductive substance can be used for the surface layer.

At first, the toner preferably has an average circularity of 0.93 to 1.00. A value obtained by the following equation is defined herein as circularity. The circularity is an index of the degree of irregularities of toner particles, and if the value is 1.00, then the shape of toner is perfect sphericity, and if the surface profile is more irregular, is getting a smaller value. The circularity is represented as follows:

Circularity SR=Circumferential length of a circle having an area equivalent to a projected area of a particle/Circumferential length of a projected image of the particle If the average circularity is in a range of 0.93 to 1.00, then respective surfaces of the toner particles are smooth, and each contact area between a toner particle and the photoconductor is small, which allows excellent transfer performance.

Toner particles have no angular portions, mixing torque of the developer in the developing device is small and mixing is stably driven, which does not cause defective images.

Because there are no angular toner particles in the toner particles to form dots, when the toner particles are press-contacted with the transfer material upon transfer, the pressure is evenly applied to all the toner particles forming dots, and voids due to improper transfer thereby hardly occur.

Because the toner particles are not angular-shaped, grinding force thereof is small, and thus, the toner particles do not damage the surface of the photoconductor nor wear the surface thereof.

The method of measuring the circularity is explained below.

The circularity can be measured by using Particle Analyzer FPIA-1000 manufactured by To a Medical Electronics.

A specific method of measuring the circularity is as follows. That is, water of 100 milliliters to 150 milliliters from which impurity solid is previously removed is put into a container, a surfactant being a dispersing agent, preferably 0.1 milliliter to 0.5 milliliter of alkylbenzene sulfonic acid, is added to the water, and sample to be measured is further added thereto by about 0.1 gram to 0.5 gram. A suspension with the sample dispersed therein is dispersed for about 1 minute to 3 minutes by an ultrasonic disperser, and concentration of a dispersing solution is controlled to 3,000 pieces/μl to 10,000 pieces/μl, and each shape and particle size of toner particles are thereby measured.

A weight-average particle size D4 of toner is preferably 3 micrometers to 10 micrometers.

In this range, the particle size of toner particles is sufficiently small with respect to fine dots of the latent image, and thus the toner particles are excellent in dot reproducibility.

If the weight-average particle size D4 is below 3 micrometers, then phenomena such as decrease in transfer efficiency and degradation of blade cleaning performance are easily occur.

If the weight-average particle size D4 exceeds 10 micrometers, then it is difficult to suppress "toner flying" of toner supposed to form a character and a line.

As for the toner, a ratio (D4/D1) between the volume-average particle size D4 and a number-average particle size D1 is preferably 1.00 to 1.40. If the value of (D4/D1) is closer to 1, a particle size distribution of toner particles is sharper.

Therefore, if (D4/D1) is in a range of 1.00 to 1.40, then selective development due to the toner particle size does not occur, and thus the toner is excellent in stability of image quality.

Because the particle-size distribution of the toner is sharp, a distribution of triboelectrically-charged amounts is also sharp, and occurrence of fogging can thereby be suppressed.

If toner particle sizes are uniform, the toner particles are developed onto dots of the latent image so as to be arrayed in a finely and orderly manner, thus being excellent in dot reproducibility.

A method of measuring a particle-size distribution of toner particles is explained below.

Examples of a measurement device of a particle-size distribution of toner particles based on Coulter Counter method are Coulter Counter TA-II and Coulter Counter Multisizer II (both manufactured by Coulter Co.). The measurement method is explained below.

A surfactant (preferably, alkylbenzene sulfonic acid) being a dispersing agent is added by 0.1 milliliter to 5 milliliters into 100 milliliters to 150 milliliters of electrolytic water. The electrolytic solution is obtained by preparing about 1% NaCl aqueous solution by using primary sodium chloride, and for example, ISOTON-II (manufactured by Coulter Co.) can be used to prepare it. Sample to be measured is further added thereto by 2 milligrams to 20 milligrams. An electrolytic solution with the sample suspended therein is dispersed for about 1 minute to 3 minutes by an ultrasonic disperser. The measurement device is used to measure the volume and the number of toner particles or toner using 100 μm-aperture and calculate a volume distribution and a number distribution. From the obtained distributions, the weight-average particle size D4 of toner and the number-average particle size D1 can be determined.

As a channel, 13 channels as follows are used and particles having a particle size not less than 2.00 micrometers (μm) to less than 40.30 μm are targeted: in μm, 2.00 to less than 2.52, 2.52 to less than 3.17, 3.17 to less than 4.00, 4.00 to less than 5.04, 5.04 to less than 6.35, 6.35 to less than 8.00, 8.00 to less than 10.08, 10.08 to less than 12.70, 12.70 to less than 16.00, 16.00 to less than 20.20, 20.20 to less than 25.40, 25.40 to less than 32.00, and 32.00 to less than 40.30.

The substantially spherical-shaped toner is preferably toner formed by crosslinking reaction and/or elongation reaction of a toner composition in an aqueous medium in the presence of resin fine particles. Specifically, the toner composition contains a polyester prepolymer having a functional group that contains nitrogen atoms, a polyester, a colorant, and a release agent. The toner manufactured using the reaction hardens the toner surface, which allows reduction in toner hot offset, and thus, it can be suppressed that the fixing device is contaminated with the toner which results in dirt appearing on an image.

An example of prepolymer formed of modified polyester resin which can be used for manufacture of toner includes an isocyanate group-containing polyester prepolymer (A), and an example of compounds that elongate or cross-link with the prepolymer includes an amine group (B).

Examples of the isocyanate group-containing polyester prepolymer (A) include reaction products of a polyester with a polyisocyanate compound (3), and the like. More specifically, the polyester is a polycondensation product between a polyol (1) and a polycarboxylic acid (2), and has an active hydrogen group. Examples of the active hydrogen group of the polyester are hydroxyl groups such as an alcoholic hydroxyl group and a phenolic hydroxyl group, an amino group, a carboxyl group, a mercapto group, and the like. Among them, the alcoholic hydroxyl group is preferred.

Examples of polyol (1) include diol (1-1) and trivalent or more polyhydric alcohols (1-2); and (1-1) alone or a mixture of (1-1) with a small amount of (1-2) is preferable. Examples of diol (1-1) include alkylene glycol (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol, and hydrogenated bisphenol A); bisphenols (e.g., bisphenol A, bisphenol F, and bisphenol S); adducts of alkylene oxide of the alicyclic diols (e.g., ethylene oxide, propylene oxide, and butylene oxide); and adducts of alkylene oxide of the bisphenols (e.g., ethylene oxide, propylene oxide, and butylene oxide). Among these, alkylene glycol having a carbon number from 2 to 12 and the adducts of alkylene oxides of the bisphenols are preferable. Particularly preferable are the adducts of alkylene oxides of the bisphenols, and a combination of the adducts of alkylene oxides of the bisphenols and alkylene glycol having a carbon number from 2 to 12. Trivalent or more polyhydric alcohols (1-2) include trihydric to octahydric alcohols and more aliphatic alcohols (e.g., glycerol, trimethylolethane, trimethylolpropane, pentaerythritol, and sorbitol); trivalent or more phenols (e.g., trisphenol PA, phenol novolak, and cresol novolak); and adducts of alkylene oxides of the trivalent or more polyphenols.

Examples of the polycarboxylic acid (2) include a dicarboxylic acid (2-1) and a trivalent or more polycarboxylic acid (2-2); and (2-1) alone and a mixture of (2-1) and a small amount of (2-2) are preferable. Examples of dicarboxylic acids (2-1) include alkylene dicarboxylic acids (e.g., succinic acid, adipic acid, and sebacic acid); alkenylene dicarboxylic acids (e.g., maleic acid and fumaric acid); and aromatic dicarboxylic acids (e.g., phthalic acid, isophthalic acid, terephthalic acid, and naphthalene dicarboxylic acid). Among these, the alkenylene dicarboxylic acids having a carbon number from 4 to 20 and the aromatic dicarboxylic acids having a carbon number from 8 to 20 are preferred. Examples of trivalent or more carboxylic acids (2-2) include aromatic polycarboxylic acids having a carbon number from 9 to 20 (e.g., trimellitic acid and pyromellitic acid). The polycarboxylic acid (2) may be reacted with polyol (1) using acid anhydrides of these or lower alkyl esters (e.g., methyl ester, ethyl ester, and isopropyl ester).

A ratio between the polyol (1) and the polycarboxylic acid (2) is usually from 2/1 to 1/1, preferably from 1.5/1 to 1/1, more preferably from 1.3/1 to 1.02/1, as an equivalent ratio of [OH]/[COOH] between a hydroxyl group [OH] and a carboxyl group [COOH].

Examples of polyisocyanate (3) are aliphatic polyisocyanates (e.g., tetramethylene diisocyanate, hexamethylene diisocyanate, and 2,6-diisocyanate methyl caproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., α, α, α', α'-tetramethylxylylene diisocyanate); isocyanates; compounds formed by blocking these polyisocyanates by a phenol derivative, an oxime, and a caprolactam; and a combination of at least two of these.

A ratio of the polyisocyanate (3) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester. When [NCO]/[OH] exceeds 5, the low-temperature fixing property gets worse. In a case of using urea-modified polyester, the urea content in the ester becomes low when a molar ratio of [NCO] is less than 1, and hot offset resistance deteriorates.

The content of the polyisocyanate (3) in the isocyanate group-containing polyester prepolymer (A) ranges usually from 0.5 wt % to 40 wt %, preferably from 1 wt % to 30 wt %, and more preferably from 2 wt % to 20 wt %. If the content of the polyisocyanate compound is less than 0.5 wt %, the hot offset resistance deteriorates, and it is 0unfavorable from the viewpoint of compatibility of heat resistant preservability and low-temperature fixing property. On the other hand, if the content of the polyisocyanate compound exceeds 40 wt %, the low-temperature fixing property gets worse.

The number of isocyanate groups contained in one molecule of the isocyanate group-containing polyester prepolymer (A) is usually at least 1, preferably, an average of 1.5 to 3, and more preferably, an average of 1.8 to 2.5. If the isocyanate group per molecule is less than 1, then the molecular weight of the urea-modified polyester becomes low and the hot offset resistance deteriorates.

Amines (B) include diamine (B1), trivalent or more polyamine (B2), amino alcohols (B3), amino mercaptans (B4), amino acids (B5), and the compounds (B6) of B1 to B5 in which their amino groups are blocked.

Examples of the diamine (B1) include aromatic diamines (e.g., phenylene diamine, diethyl toluene diamine, and 4,4'-diaminodiphenyl methane); alicyclic diamines (e.g., 4,4'-diamino-3,3'-dimethyldicyclohexylmethane, diamine cyclohexane, and isophorone diamine); and aliphatic diamines (e.g., ethylene diamine, tetramethylene diamine, and hexamethylene diamine). Examples of the trivalent or more amine compounds (B2) include diethylene triamine and triethylene tetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6), in which the amino groups of B1 to B5 are blocked, include ketimine compounds obtained from the amines of B1 to B5 and ketones (e.g., acetone, methyl ethyl ketone, and methyl isobutyl ketone), and oxazolidine compounds. The preferable amines among the amines (B) are B1 and a mixture of B1 with a small amount of B2.

A reaction inhibitor is used as required for crosslinking reaction between a polyester prepolymer (A) and amines (B) to obtain the modified polyester (i) and/or elongation reaction, thereby adjusting the molecular weight of the urea-modified polyester obtained. Examples of the reaction inhibitor include monoamines (e.g., diethylamine, dibutylamine, butylamine, and laurylamine), and compounds (ketimine compounds) in which the monoamines are blocked.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amine group [NHx] in the amines (B). When [NCO]/[NHx] exceeds 2 or is less than ½, the molecular weight of the urea-modified polyester(i) becomes smaller, resulting in deterioration in hot offset resistance. An urethane bond may be contained together with an urea bond in the polyester modified urea bond. A molar ratio of the urea bond content and the urethane bond content ranges usually from 100/0 to 10/90, preferably from 80/20 to 20/80, and more preferably from 60/40 to 30/70. If the molar ratio of the urea bond is less than 10%, the hot offset resistance deteriorates.

The urea-modified polyester (i) can be made by these reactions. The urea-modified polyester (i) is manufactured by a one shot method and a prepolymer method. The weight-average molecular weight of the urea-modified polyester (i) is usually not less than 10,000, preferably 20,000 to 10,000,000, and more preferably 30,000 to 1,000,000. If the weight-average molecular weight is less than 10,000, the hot offset resistance deteriorates. A number-average molecular weight of the urea-modified polyester (i) is not particularly limited when a native polyester (ii) explained later is used, and the number-average molecular weight should be one which is easily obtained to get a weight-average molecular weight. When the urea-modified polyester (i) is used alone, the number-average molecular weight is usually 20,000 or less, preferably 1,000 to 10,000, and more preferably 2,000 to 8,000. When the number-average molecular weight exceeds 20,000, the low-temperature fixing property deteriorates and the glossiness also deteriorates when used for full-color apparatus.

The urea-modified polyester (i) can be used alone, and also a native polyester (ii) can be contained together with (i) as a binder resin component. By using (i) in combination with the native polyester (ii), the low-temperature fixing property is improved and the glossiness is also improved when used for full-color apparatus, which is more preferable than a single use of (i). Examples of the native polyester (ii) include polycondensation of polyol (1) and polycarboxylic acid (2), similarly to the polyester component of (i), and preferred compounds are also the same as (i). The native polyester (ii) may be not only a native polyester but also modified one through a chemical bond other than an urea bond, for example, (ii) may be modified with an urethane bond. It is preferable that at least parts of (i) and (ii) are compatible with each other, from viewpoint of low-temperature fixing property and hot offset resistance. Therefore, polyester components of (i) and (ii) have preferably similar compositions. A weight ratio between (i) and (ii) when (ii) is contained is usually 5/95 to 80/20, preferably 5/95 to 30/70, more preferably 5/95 to 25/75, and particularly preferably 7/93 to 20/80. When the weight ratio of (i) to (ii) is less than 5%, the hot offset resistance deteriorates, and this becomes disadvantageous in respect of compatibility between heat resistant preservability and low-temperature fixing property.

The peak molecular weight of (ii) is usually 1,000 to 30,000, preferably 1,500 to 10,000, and more preferably 2,000 to 8,000. When it is less than 1,000, heat resistant preservability deteriorates, and when it exceeds 10,000, low-temperature fixing property deteriorates. A hydroxyl value of (ii) is preferably 5 or more, more preferably 10 to 120, and particularly preferably 20 to 80. When it is less than 5, it becomes disadvantageous in respect of compatibility between the heat resistant preservability and the low-temperature fixing property. An acid value of (ii) is preferably 1 to 30, and more preferably 5 to 20. By having the acid value tends to be easily negative electric.

A glass transition point (Tg) of binder resin is usually from 50° C. to 70° C., and preferably from 55° C. to 65° C. If Tg is less than 50° C., blocking when toner is stored under high temperature deteriorates, while if Tg exceeds 70° C., the low temperature fixing property becomes insufficient. Under coexistence with urea-modified polyester resin, the dry toner tends to show better heat resistant preservability as compared with known polyester toner, even if the glass transition point is low. The temperature (TG') at which the storage elastic modulus of the binder resin at a measuring frequency of 20 Hz is 10000 dyne/cm$^2$ is usually 100° C. or more, preferably from 110° C. to 200° C. If it is less than 100° C., then hot offset resistance deteriorates. The temperature (Tη) at which the viscosity of the binder resin is 1000 poises at the measuring frequency of 20 Hz is usually 180° C. or less, preferably from 90° C. to 160° C.

If the temperature exceeds 180° C., the low temperature fixing property deteriorates. More specifically, TG' is preferably higher than Tη in terms of compatibility between the low temperature fixing property and the hot offset resistance. In other words, a difference between TG' and Tη (TG'−Tη) is preferably 0° C. or more, more preferably 10° C. or more, and particularly preferably 20° C. or more. The upper limit of the difference is not particularly defined. Moreover, in terms of compatibility between the heat resistant preservability and the low temperature fixing property, a difference between Tη and Tg is preferably from 0° C. to 100° C., more preferably from 10° C. to 90° C., and particularly preferably from 20° C. to 80° C.

The binder resin is manufactured by the following method. Polyol (1) and polycarboxylic acid (2) is heated to 150° C. to 280° C. in the presence of a known esterification catalyst such as tetrabutoxytitanate and dibutyltin oxide, and by distilling water generated while pressure is reduced if required, and polyester having the hydroxyl group is obtained. Polyisocyanate (3) is reacted with the polyester at a temperature of 40° C. to 140° C. to obtain isocyanate group-containing prepolymer (A). The amine group (B) is further reacted with (A) at the temperature of 0° C. to 140° C. to obtain polyester (i) modified by urea bond. When (3) is reacted or (A) and (B) are reacted, a solvent can be used if necessary.

Examples of available solvent include those inactive to isocyanate, such as an aromatic solvent (e.g., toluene, and xylene); ketone group (e.g., acetone, methyl ethyl ketone, and methyl isobutyl ketone); ester group (e.g., ethyl acetate); amide group (e.g., dimethylformamide, and dimethylacetoamide); and ether group (e.g., tetrahydrofuran). When polyester (ii) not modified by urea bond is used at the same time, the polyester (ii) is prepared using the same method as that of the polyester having hydroxyl group, and is dissolved in and mixed with the polyester (i).

The toner can be manufactured roughly in the following method, but the method is not limited thereby.

As an aqueous medium, water may be used singly or in combination with water-soluble solvent. Examples of the water-soluble solvent include alcohol (e.g., methanol, isopropanol, and ethylene glycol), dimethyl formamide, tetrahydrofuran, cellosolves (e.g., methyl cellosolve), and lower ketones (e.g., acetone, methyl ethyl ketone).

The toner particles may be formed by reacting a dispersion of isocyanate group-containing prepolymer (A) with the amine group (B) in the aqueous medium, or previously manufactured urea-modified polyester (i) may be used. An example of the method of stably forming a dispersion of the urea-modified polyester (i) and the prepolymer (A) in the aqueous medium includes a method of adding a composition of toner materials formed of the urea-modified polyester (i) and the prepolymer (A) to the aqueous medium and dispersing it by shear force.

The prepolymer (A) and other toner compositions i.e., toner materials, such as a colorant, colorant master batch, a release agent, a charge control agent, and unmodified polyester resin may be mixed upon formation of the dispersion in the aqueous medium. However, it is more preferred that the toner materials are previously mixed and then the mixture is added to the aqueous medium and dispersed. The other toner materials such as the colorant, the release agent, and the charge control agent are not necessarily mixed when particles are formed in the aqueous medium, and therefore, the other toner materials may be added to the aqueous medium after particles are formed. For example, particles without a colorant are formed and then a colorant can be added thereto in a known dyeing method.

The dispersion method is not particularly limited, and it is possible to use known facilities of a low-speed shearing type, a high-speed shearing type, a friction type, a high-pressure jet type, and an ultrasonic type. Among these, the high-speed shearing type is preferred to obtain dispersed particles having a particle size ranging from 2 micrometers to 20 micrometers. When a high-speed shearing type dispersing machine is used, the number of revolutions is not particularly limited, and is usually from 1,000 to 30,000 revolutions per minute (rpm), preferably from 5,000 rpm to 20,000 rpm. The dispersion time is not particularly limited and is usually from 0.1 minute to 5 minutes in a batch system. The dispersing temperature is usually from 0° C. to 150° C. (under a pressure), preferably from 40° C. to 98° C. Higher temperature is preferred because the dispersion containing the urea-modified polyester (i) and the prepolymer (A) has low viscosity and easily disperses.

The use amount of the aqueous medium for 100 wt. parts of the toner materials containing the urea-modified polyester (i) and the prepolymer (A) is usually 50 wt. parts to 2,000 wt. parts, preferably 100 wt. parts to 1,000 wt. parts. If the amount is less than 50 wt. parts, the toner materials are poorly dispersed, and it is thereby impossible to obtain toner particles having a predetermined particle size. On the other hand, if the amount exceeds 20,000 wt. parts, this is economically inefficient. Moreover, the dispersing agent can also be used according to need. It is preferable to use the dispersing agent because the particle-size distribution becomes sharp and dispersion is stabilized.

The process of synthesizing the urea-modified polyester (i) from the prepolymer (A) may be in such a manner that the amines (B) are added before the toner materials are dispersed in the aqueous medium to cause reaction, or may be in such a manner that the amines (B) are added after the toner materials are dispersed in the aqueous medium to cause reaction from particle interface. In this case, urea-modified polyester is preferentially generated on the surface of manufactured toner, and thus, it is also possible to provide concentration gradient inside a particle.

Examples of the dispersing agent used to be emulsified and dispersed an oil phase dispersed the toner materials to liquid including water, include anionic surfactants such as alkyl benzene sulfonate, α-olefin sulfonate, and ester phosphate; amine salts such as alkyl amine salts, aminoalcohol fatty acid derivatives, polyamine fatty acid derivatives, and imidazoline; cationic surfactants of quaternary ammonium salt types such as alkyl trimethyl ammonium salts, dialkyl dimethyl ammonium salts, alkyl dimethyl benzyl ammonium salts, pyridinium salts, alkyl isoquinolinium salts, and benzethonium chloride; nonionic surfactants such as fatty acid amide derivatives and polyhydric alcohol derivatives; and zwitterionic surfactants such as alanine, dodecyl di(aminoethyl) glycine, di(octylaminoethyl) glycine, N-alkyl-N, and N-dimethyl ammonium betaine.

Furthermore, a surfactant having a fluoroalkyl group is used to achieve a desired effect with a very small amount thereof. Preferable examples of anionic surfactants having a fluoroalkyl group are fluoroalkyl carboxylic acids having a carbon number from 2 to 10 and their metal salts; disodium perfluorooctane sulfonyl glutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid and its metal salts; perfluoroalkyl carboxylic acid (C7 to C13) and its metal salts; perfluoroalkyl (C4 to C12) sulfonic acid and its metal salts, perfluorooctane sulfonic acid diethanolamide, N-propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethylsulfonyl glycine salts, monoperfluoroalkyl (C6 to C16) ethyl phosphoric acid esters.

Examples of trade names are SURFLON S-111, S-112, and S113 (manufactured by Asahi Glass Co., Ltd.), FLUORAD FC-93, FC-95, FC-98, and FC-129 (manufactured by Sumitomo 3M Co., Ltd.), UNIDINE DS-101 and DS-102 (manufactured by Daikin Industries, Ltd.), MEGAFACE F-110, F-120, F-113, F-191, F-812, and F-833 (manufactured by Dainippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by Neos Co., Ltd.).

Examples of cationic surfactants are aliphatic primary, secondary, or tertiary amine containing a fluoroalkyl group, aliphatic quaternary ammonium salt such as ammonium salt of perfluoroalkyl (C6-C10) sulfonamide propyl trimethyl; benzalkonium salts, benzethonium chloride, pyridinium salts, and imidazolinium salts. Trade names thereof are SURFLON S-121 (manufactured by Asahi Glass Co., Ltd.), FLUORAD FC-135 (manufactured by Sumitomo 3M Co., Ltd.), UNIDYNE DS-202 (manufactured by Daikin Industries, Ltd.), MEGAFACE F-150 and F-824 (manufactured by Dainippon Ink & Chemicals, Inc.), EKTOP EF-132 (manufactured by Tochem Products Co., Ltd.), and FTERGENT F-300 (manufactured by Neos Co., Ltd.), or the like.

Moreover, poorly water-soluble inorganic dispersing agents can also be used such as calcium phosphate tribasic, calcium carbonate, titanium oxide, colloidal silica, and hydroxyapatite.

Dispersion droplets may be stabilized by a high polymer protective colloid. Examples are acids such as acrylic acid, methacrylic acid, α-cyanoacrylic acid, α-cyanomethacrylic acid, itaconic acid, crotonic acid, fumaric acid, maleic acid, or maleic anhydride; or methacrylic monomers containing a hydroxyl group such as hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerol monoacrylic ester, glycerol monomethacrylic ester, N-methylol acrylamide, N-methylol methacrylamide; vinyl alcohol or ethers with vinyl alcohol such as vinyl methyl ether, vinyl ethyl ether, vinyl propyl ether; or esters of compounds that contains a vinyl alcohol and a carboxyl group such as vinyl acetate, vinyl propionate, vinyl butyrate; acrylamide, methacrylamide, diacetone acrylamide or their methylol compounds; acid chlorides such as chloride acrylate and chloride methacrylate; homopolymers or copolymers of nitrogen atom such as vinylpyridine, vinylpyrrolidone, vinylimidazole, and ethyleneimine or of heterocyclic ring thereof; polyoxyethylene compounds such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester; and a cellulose group such as methyl cellulose, hydroxyethyl cellulose, and hydroxypropyl cellulose.

If a compound like calcium phosphate salt that can dissolve in an acid or an alkali is used as a dispersion stabilizer, after the calcium phosphate salt is dissolved by an acid like hydrochloric acid, the calcium phosphate salt is removed from fine particles by a method of washing. In addition, the calcium phosphate salt can be removed through decomposition by an enzyme.

When the dispersing agent is used, the dispersing agent is allowed to remain on the surface of the toner particle, but removal of the dispersing agent by washing after elongation and/or crosslinking reaction is preferred in terms of charging of toner.

Furthermore, to decrease the viscosity of the toner materials, a solvent in which urea-modified polyester (i) and prepolymer (A) are soluble can be used. It is preferred to use the solvent because the particle-size distribution becomes sharp. The solvent is preferably volatile because of easy removal. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone, and these can be used singly or in combination of two or more. In particular, aromatic solvent such as toluene and xylene; and halogenated hydrocarbon such as methylene chloride, 1,2-dichloroethane, chloroform, and carbon tetrachloride are preferred, and the aromatic solvent such as toluene and xylene is more preferred. The use amount of solvent is usually 0 to 300 parts for 100 parts of prepolymer (A), preferably 0 to 100 parts, and more preferably 25 to 70 parts. When the solvent is used, the solvent is heated under normal pressure or reduced pressure after elongation and/or crosslinking reaction, and is removed.

An elongation and/or crosslinking reaction time is selected according to the reactivity of a combination of an isocyanate group structure of the prepolymer (A) and amines (B), and is usually 10 minutes to 40 hours, preferably 2 hours to 24 hours. The reaction temperature is usually from 0° C. to 150° C., preferably from 40° C. to 98° C. Moreover, a known catalyst can be used according to need. Specific examples of the catalyst are dibutyltin laurate and dioctyltin laurate.

To remove an organic solvent from an obtained emulsified dispersion, it is possible to use a method of gradually heating up the whole system and perfectly evaporating and removing an organic solvent in droplets. Alternatively, it is also possible to spray the emulsified dispersion in a dry atmosphere, perfectly remove water-insoluble organic solvent in droplets to form toner particles, and also evaporate and remove an aqueous dispersing agent. As the dry atmosphere in which the emulsified dispersion is sprayed, gas, especially, various types of airflows are generally used. More specifically, the gas is obtained by heating air, nitrogen, carbon dioxide, combustion gas, or the like, and the various types of airflows are obtained by heating a solvent to be used having the maximum boiling point to the boiling point or more. Targeted quality can be sufficiently obtained by a process using a spray dryer, a belt dryer, or a rotary kiln in a short time.

When the particle-size distribution upon dispersion of emulsified dispersion is broad and washing and drying processes are performed while keeping the particle-size distribution, the broad particle-size distribution is classified into desired particle-size distributions, so that the particle-size distributions can be put in order.

The classification is operated in the solution by a cyclone, decanter, or centrifugal separation, so that fine particle parts can be removed from the solution. The classification may also be operated after particles are obtained as powder after being dried, but the operation in the solution is preferred in terms of efficiency. Obtained unnecessary fine particles or coarse particles are returned again to the kneading process so that these particles can be used to form particles. In this case, fine particles or coarse particles may be wet.

It is preferable to remove the used dispersing agent from the dispersion solution as much as possible, but it is more preferable to perform the removal operation together with the classification operation.

The powder of toner obtained after being dried is mixed with heterogenous particles such as release-agent particles, charge-control-agent particles, fluidizing-agent particles, and colorant particles, and mechanical impacts are given to the mixed powder, to cause the particles to be solidified and melted on each surface of the toner particles to obtain composite particles. Thus, desorption of the heterogenous particles from the surfaces of the composite particles can be prevented.

Specific means includes a method of providing an impact to the mixture by blades rotating at high speed, and a method of inputting the mixture into a high-speed airflow, accelerating the airflow, and impinging particles against each other or composite particles against an appropriate impinging plate. Devices include Ong Mill (manufactured by Hosokawa Micron Corp.), a device which is modified from I-Type Mill (manufactured by Nippon Pneumatic Mfg. Co., Ltd.) and reduces pulverizing air pressure, Hybridization System (manufactured by Nara Kikai Seisakusho), Cryptron System (manufactured by Kawasaki Heavy Industries, Ltd.), and an automatic mortar.

As colorants used for the toner, all dyes and pigments conventionally used as colorant for toner can be used. Examples thereof are carbon black, lamp black, iron black, ultramarine blue, nigrosine dye, aniline blue, phthalocyanine blue, phthalocyanine green, Hansa yellow G, rhodamine 6C lake, chalco-oil blue, chrome yellow, quinacridone red, benzidine yellow, and rose bengal, and these materials can be used singly or in combination.

To further provide magnetic property to the toner particle itself as required, magnetic components of iron oxides such as ferrite, magnetite, and maghemite; metal such as iron, cobalt, and Nickel; or alloys of these materials and other metals may be contained alone or in combination thereof in the toner particle. These components can be also used as colorant components and also used in combination with others.

The number-average particle size of the colorant in the toner is desirably 0.5 micrometer or less, preferably 0.4 micrometer or less, more preferably 0.3 micrometer or less.

If the number-average particle size of the colorant in the toner is 0.5 micrometer or more, then dispersion of pigments does not reach an adequate level and preferable transparency cannot sometimes be obtained.

The colorant of a fine particle size smaller than 0.1 micrometer is sufficiently smaller than a half-wavelength of the visible light, and thus, it is considered that the colorant does not affect reflection and absorption properties of light. Therefore, the particles of colorant having a size less than 0.1 micrometer are useful for better color reproducibility and transparency of an overhead projector (OHP) sheet with a fixed image thereon. On the other hand, if there are many colorants having a particle size larger than 0.5 micrometer, transmission of incident light is thereby blocked or the incident light is caused to scatter, and brightness and vividness of a projected image of the OHP sheet thereby tend to lower.

Furthermore, if there are many colorants having a particle size larger than 0.5 micrometer, it is not preferred because the colorants are desorbed from the surface of the toner particle, which easily causes various troubles such as fogging, drum contamination, defective cleaning. Particularly, the number of colorants having a particle size larger than 0.7 micrometer is preferably 10 number % or less of the all colorants, more preferably 5 number % or less.

The colorants and part of or the whole of the binder resin are previously applied with a moisturizing agent and kneaded, and the binder resin and the colorants thereby sufficiently adhere to each other in the initial stage. Thereafter, the colorants are effectively dispersed on a toner particle in a toner manufacturing process, the dispersed particle size of the colorant becomes smaller, and further more transparency can thereby be obtained.

As the binder resin used for kneading in the previous stage, the resin group shown as the binder resin for toner can be used as it is, but the binder resin is not limited thereby.

A specific method of previously kneading the mixture of the binder resin and the colorants with the moisturizing agent includes a method of mixing the binder resin, the colorants, and the moisturizing agent by a blender such as a Henschel mixer, and kneading the mixture by a kneader with two rolls or three rolls at a temperature lower than a melting temperature of the binder resin, to obtain a sample.

As the moisturizing agent, ordinary agents can be used in view of melting property of the binder resin and applying capability with the colorants, and especially, organic solvent such as acetone, toluene, and butanone and water are preferred in terms of dispersion capability of the colorants.

Among these materials, water is more preferably used from the view point of environmental concerns and maintenance of dispersion stability of colorants in the following toner manufacturing process.

According to the method, the particle size of the colorant particles contained in the obtained toner becomes small and homogeneity in the dispersed state of the particles increases. Thus, the color reproducibility of an projected image by the OHP becomes further better.

In addition, a release agent such as wax can also be contained together with the binder resin and the colorants in the toner.

As a release agent, known materials can be used. Examples thereof include polyolefin wax (e.g., polyethylene wax and polypropylene wax); long chain hydrocarbon (e.g., paraffin wax and Sasol Wax); and carbonyl group-containing wax.

Preferred one of these is carbonyl group-containing wax. Examples of carbonyl group-containing wax include polyalkanoic acid ester (e.g., carnauba wax, montan wax, trimethylolpropane tribehenate, pentaerythritol tetrabehenate, pentaerythritol diacetate dibehenate, glycerin tribehenate, 1,18-octadecanediol distearate); polyalkanol ester (e.g., trimellitic acid tristearyl, distearyl maleate); polyalkanoic acid amide (e.g., etylenediamine dibehenylamide); polyalkylamide (e.g., tristearylamide trimellitate); and dialkyl ketone (e.g., distearyl ketone).

Among these carbonyl group-containing waxes, preferred one is polyalkanoic acid ester. The melting point of these release agents is usually from 40° C. to 160° C., preferably from 50° C. to 120° C., and more preferably from 60° C. to 90° C. A wax with a melting point of lower than 40° C. may adversely affect the heat-resistance storageability. In contrast, a wax with a melting point of higher than 160° C. may often cause cold offset upon image fixing at low temperatures. The melt viscosity of the wax is preferably from 5 cps to 1000 cps, and more preferably from 10 cps to 100 cps as a measured value at a temperature which is 20° C. higher than its melting point. A wax with a melt viscosity of more than 1000 cps may not satisfactorily contribute to improved hot offset resistance and image-fixing properties at low temperatures. A content of the wax in the toner is usually from 0 wt % to 40 wt %, and preferably from 3 wt % to 30 wt %.

To speed up the charge amount of toner and its start-up, a charge control agent may be contained in the toner according to need. In this case, if a colored material is used as the charge control agent, the color is caused to change, and thus, any material close to monochrome and white color is preferred.

Known charge control agents can be used as a charge control agent, and include, for example, triphenylmethane dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives. More specific examples of the charge control agents are Bontron P-51 as quaternary ammonium salts, E-82 as oxynaphthoic acid type metal complex, E-84 as salicylic acid metal complex, E-89 as phenol type condensate (these are manufactured by Orient Chemical Industries, Ltd.), TP-302 and TP-415 as quaternary ammonium salt molybdenum complexes (manufactured by Hodogaya Chemical Industries, Ltd.), Copy Charge PSY VP2038 as quaternary ammonium salt and Copy Charge NX VP434 as quaternary ammonium salt (these are manufactured by Hoechst Co., Ltd.), LRA-901 and LR-147 as boron complex (manufactured by Japan Carlit Co., Ltd.), quinacridone, azo type pigments, and polymer compounds having a functional group such as a sulfonic acid group, a carboxyl group, and a quaternary ammonium salt group.

The use amount of the charge control agent is determined depending on the type of binder resins, presence or absence of additives to be used as required, and a method of manufacturing toner including a dispersion method, and hence, it is not uniquely limited. However, the charge control agent is used preferably in a range from 0.1 to 10 parts by weight (wt. parts), and more preferably from 0.2 to 5 wt. parts, per 100 wt.

parts of the binder resin. If it exceeds 10 wt. parts, the toner is charged too highly, which causes effects of the charge control agent to be decreased, electrostatic attracting force with a developing roller to be increased, fluidity of the developer to be lowered, and image density to be reduced. These charge control agent can be melted and kneaded with the master batch and the resin and then the mixture can be dissolved and dispersed, or may be directly added to organic solvent at a time of dissolution and dispersion, or may be solidified on the toner surface after toner particles are formed.

When the toner materials are dispersed in the aqueous medium during the toner manufacturing process, resin fine particles may be added to the toner materials to mainly stabilize the dispersion.

The resin fine particles to be use may be of any resin selected from thermoplastic resins and thermosetting resins, if an aqueous dispersion may be formed from the resin fine particles. Examples of the resins include vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins may be used in combination of two or more types as resin fine particles. Among these, vinyl resins, polyurethane resins, epoxy resins, polyester resins, and combinations thereof are preferred, since aqueous dispersions of resin spherical fine particles can be easily obtained.

Examples of the vinyl resins include polymers in which vinyl monomer is singly polymerized or copolymerized with other monomers, such as styrene-methacrylic ester copolymers, styrene-butadiene copolymers, methacrylic acid-acrylic ester copolymers, styrene-acrylonitrile copolymers, styrene-maleic acid anhydride copolymers, and styrene-methacrylic acid copolymers. However, the vinyl resins are not limited thereby.

Inorganic fine particles are preferably used as an external additive to facilitate fluidity, developing performance, and chargeability of toner particles. Such an inorganic fine particle has preferably a primary particle diameter of $5\times10^{-3}$ to 2 micrometers. In particular, the primary particle diameter is preferably 5 nanometers to 500 nanometers. A specific surface area by the BET method is preferably 20 m2/g to 500 m2/g. The use ratio of the inorganic fine particles is preferably 0.01 wt % to 5 wt % in toner particles, and more preferably 0.01 wt % to 2.0 wt %. Specific examples of the inorganic particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride.

In addition, there are polymer type fine particles, for example, polystyrene, methacrylic acid ester and acrylic acid ester copolymers, and a polycondensation type such as silicone, benzoguanamine, and nylon, which are prepared by soap-free emulsion polymerization, suspension polymerization, or dispersion polymerization; and polymer particles prepared from thermosetting resin.

These external additives are subjected to surface treatment to increase hydrophobicity, so that deterioration of fluid characteristics and charging characteristics can be prevented even under high humidity. Examples of a preferred surface treatment agent include a silane coupling agent, a silylating agent, a silane coupling agent having a fluorinated alkyl group, an organic titanate type coupling agent, an aluminum type coupling agent, silicone oil, and modified silicon oil.

Examples of a cleaning improving agent to remove a developer remaining on a photoconductor and a primary transfer device after an image is transferred therefrom include fatty acid metal salt such as zinc stearate, calcium stearate, and stearic acid; and polymer fine particles such as polymethyl methacrylate fine particles and polystyrene fine particles manufactured by soap-free emulsion polymerization or the like. The polymer fine particles have comparatively narrow particle-size distribution, and particles having a volume-average particle size of 0.01 micrometer to 1 micrometer are preferable.

By using these toner particles, a high-quality toner image excellent in development stability can be formed. However, some toner particles remain on the photoconductor without being transferred onto a transfer material or an intermediate transfer member by the transfer device. Because it is difficult to remove the toner particles by the cleaning device due to their fineness and high rolling motion, and the toner particles often pass through under the cleaning device. To perfectly remove the toner particles from the photoconductor, a toner removing element such as a cleaning blade needs to be strongly pressed against the photoconductor. Such a load results in reduction in lives of the photoconductor and the cleaning device and also results in unnecessary energy consumption.

When the load to the photoconductor is reduced, removal of the toner particles and small-sized carrier particles from the photoconductor becomes insufficient, and these particles give damage to the surface of the photoconductor when passing through the cleaning device, which causes the performance of the image forming apparatus to vary.

According to this embodiment, the image forming apparatus has a wider tolerance to variation in the surface state of the photoconductor, especially to a presence at a low resistance portion, and highly suppresses variation in the charging performance to the photoconductor. Therefore, by using the toner, the image forming apparatus can stably obtain extremely high-quality images over the long period of time.

The image forming apparatus can use the toner suitable to obtain the high-quality images and also use irregular toner obtained by a pulverizing method, which can greatly extend the life of the apparatus.

Materials containing the toner due to the pulverizing method are not particularly limited, and thus, the materials generally used for toner for electrophotography can be used.

Examples of ordinary binder resins used for the toner include styrenes such as polystyrene, poly-p-chlorostyrene, and polyvinyltoluene, and substituted homopolymers thereof; styrene copolymers such as styrene-p-chlorostyrene copolymer, styrene-propylene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-methacrylic acid methyl copolymer, styrene-methacrylic acid ethyl copolymer, styrene-methacrylic acid butyl copolymer, styrene-α-chloromethacrylic acid methyl copolymer, styrene-acrylonitrile copolymer, styrene-vinyl methyl ketone copolymer, styrene-butadiene copolymer, styrene-isoprene copolymer, and styrene-maleic acid copolymer; acrylic acid ester homopolymers and copolymers thereof such as polymethyl acrylate, polybutyl acrylate, polymethyl methacrylate, polybutyl methacrylate; polyvinyl derivatives such as polyvinyl chloride, and polyvinyl acetate; polyester polymer, polyurethane polymer, polyamide polymer, polyimide polymer, polyol polymer, epoxy polymer, terpene polymer, fatty series or alicyclic hydrocarbon resin, and aromatic petroleum resin.

These materials can be used singly or in combination, but the material for the binder resin is not particularly limited thereby. At least one selected from among styrene-acrylic acid copolymers, polyester resins, and polyol resins is more preferred in terms of electrical properties and cost. Polyester resins and/or polyol resins are more preferably used as one having excellent fixing capability.

From the above-mentioned reasons, if the material is the same as the resin component forming the binder resin of the toner contained in a coating layer of the charging element, at least one of linear polyester resin composition, linear polyol resin composition, linear styrene acrylic resin composition, or crosslinked products thereof can be preferably used.

The toner obtained by using the pulverizing method is formed simply by being subjected to the following processes in which the colorant components, the wax components, and the charge controlling components are mixed together with these resin components as required, the mixture is kneaded at a temperature near or less than the melting temperature of the resin components, the kneaded mixture is cooled down, and then it reaches a pulverizing/classifying process. The external additives may be added thereto and mixed according to need.

EXAMPLES

Although the present invention is explained in further detail below in the following examples, the present invention is not limited by the examples. In the example, the explanation is targeted on the protective-agent bar 21 shown in FIG. 1. However, the protective-agent bar in the following is not indicated by the reference numeral 21 because the way to manufacture it is different, and categorizing codes such as 1-1, 1-2, 1-3, and 1-4 are used instead for differently manufactured protective-agent bars.

Method of Manufacturing Protective-Agent Bar 1-1

Normal paraffin (average molecular weight 640) of 69 wt. parts and sorbitan monostearate (HLB: 5.9) of 31 wt. parts were put into a glass container with a lid, and stirred and melted by a hot stirrer in which temperature was controlled to 120° C.

The melted composition due to protective-agent formula 1-1 was poured into an aluminum-made die having previously been heated to 83° C. so as to be filled therewith. The die had inner dimensions of 12 mm×8 mm×350 mm. The composition was cooled down to 50° C. in room-temperature atmosphere, and then the composition was again heated up to 60° C. in a temperature-controlled bath in which the temperature was set and was left for 20 minutes at the same temperature, and thereafter, the composition was cooled down to the room temperature.

After cooled down, the solid matter was removed from the die, both ends thereof in the longitudinal direction were cut, the bottom thereof was cut to prepare a 7 mm×8 mm×310 mm-protective-agent bar 1-1. A double-stick tape was adhered to the bottom of the protective-agent bar, and the protective-agent bar was fixed to a metal-made support.

The surface of the protective-agent bar 1-1 was scratched by a 6B pencil, and a scratch was found thereon. Therefore, it is clear that the protective-agent bar 1-1 was softer than 6B.

A 10-mg sample was obtained from the protective-agent bar 1-1, and an endothermic peak was measured by using Differential Scanning Calorimeter DSC-60 (manufactured by Shimadzu Corp.). As a result, the endothermic peaks were obtained at 53° C. and 88° C.

Method of Preparing Protective-Agent Bar 1-2

A protective-agent bar 1-2 was prepared using a method similarly to the method of preparing the protective-agent bar 1-1 except for using 39 wt. parts of FT 115 (synthetic wax manufactured by NIPPON SEIRO CO., LTD.) and 61 wt. parts of sorbitan tristearate (HLB: 15).

The surface of the protective-agent bar 1-2 was scratched by a 6B pencil, and a scratch was found thereon. Therefore, it is clear that the protective-agent bar 1-2 was softer than 6B.

A 10-mg sample was obtained from the protective-agent bar 1-2, and an endothermic peak was measured by using Differential Scanning Calorimeter DSC-60 (manufactured by Shimadzu Corp.). As a result, the endothermic peaks were obtained at 56° C. and 95° C.

Method of Preparing Protective-Agent Bar 1-3

A protective-agent bar 1-3 was prepared using a method similarly to the method of preparing the protective-agent bar 1-1 except for using 75 wt. parts of normal paraffin (average molecular weight 640) and 25 wt. parts of glyceryl monostearate (HLB: 3.5).

The surface of the protective-agent bar 1-3 was scratched by a 6B pencil, and a scratch was found thereon. Therefore, it is clear that the protective-agent bar 1-3 was softer than 6B.

A 10-mg sample was obtained from the protective-agent bar 1-3, and an endothermic peak was measured by using Differential Scanning Calorimeter DSC-60 (manufactured by Shimadzu Corp.). As a result, the endothermic peaks were obtained at 53° C. and 88° C.

Method of Preparing Protective-Agent Bar 1-4

A protective-agent bar 1-4 was prepared using a method similarly to the method of preparing the protective-agent bar 1-1 except for using only zinc stearate for the protective agent and putting the zinc stearate into a glass container with a lid and melting it while stirring by a hot stirrer in which the temperature was controlled to 165° C.

The surface of the protective-agent bar 1-4 was scratched by a 4B pencil, but no scratch was found thereon. However, a scratch was found when it was scratched by a 2B pencil. As a result, it is clear that the hardness of the surface of the protective-agent bar 1-4 was between pencil hardness 4B and 2B.

Examples 1-1, 1-2, 1-3, and Comparative Example 1-1

An undercoat layer, a charge generation layer, a charge transport layer, and a protective layer were applied in this order to an aluminum drum (conductive support) having a diameter of 30 millimeters, and were dried to prepare a photoconductor including a undercoat layer of 3.6 micrometers, a charge generation layer of about 0.14 micrometer, a charge transport layer of 23 micrometers, and a protective layer of about 3.5 micrometers. It is noted that the protective layer was applied by a spray method while the other layers were applied by a dip coating method. The same formula as that of alumina having an average particle size of 0.18 micrometer was added by 23.8 mass % to the charge transport layer was used for the protective layer.

Figure 4:
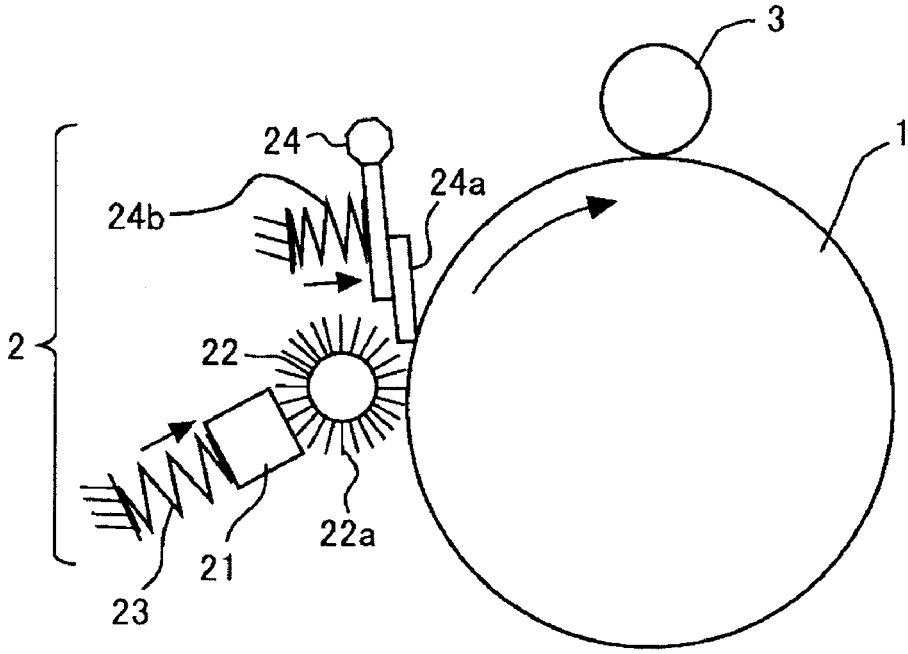
FIG. 4 is a schematic diagram for explaining a function of a protective-agent bar according to a second embodiment of the present invention.

Photoconductors and the protective-agent bars 1-1, 1-2, 1-3, and 1-4 were set in photoconductor units for black each configured as shown in FIG. 4 using Imagio Neo C385 (tandem-type color image forming apparatus manufactured by RICOH COMPANY, LTD), and four types of photoconductor units were prepared.

Next, the photoconductor units were not incorporated in the image forming apparatus and not charged, and the photoconductors were rotated for 10 minutes at 130 rpm and only the protective agent was applied to the photoconductors.

The surface of the photoconductor under the charger after the protective agent of the protective-agent bar 1-1 was applied thereto was observed by using an electron microscope, and then it was found that the number of particles of 1.5 micrometers or more of the protective agent was 5 per 1 $mm^2$.

The surface of the photoconductor under the charger after the protective agent of the protective-agent bar 1-2 was applied thereto was observed by using the electron microscope, and then it was found that the number of particles of 1.5 micrometers or more of the protective agent was 12 per 1 $mm^2$.

The surface of the photoconductor under the charger after the protective agent of the protective-agent bar 1-3 was applied thereto was observed by using the electron microscope, and then it was found that the number of particles of 1.5 micrometers or more of the protective agent was 7 per 1 $mm^2$.

The surface of the photoconductor under the charger after the protective agent of the protective-agent bar 1-4 was applied thereto was observed by using the electron microscope, and then it was found that the number of particles of 1.5 micrometers or more of the protective agent was 589 per 1 $mm^2$.

The surface of the photoconductor under the brush for supplying the protective agent after the protective agent of the protective-agent bar 1-1 was applied thereto was observed by using the electron microscope, and then it was found that the number of particles of 1.5 micrometers or more of the protective agent was 7 per 1 $mm^2$.

The protective agent of the protective-agent bar 1-1 was applied to the photoconductor, and a deposition on the surface of the photoconductor was scraped by using KBr and was analyzed by FT-IR using a KBr method. As a result, peaks derived from normal paraffin and sorbitan monostearate were detected, and thus, it is found that the protective agent of the protective-agent bar 1-1 was deposited on the photoconductor.

After the observation and analysis, the photoconductor units were not incorporated in the image forming apparatus but the configuration was kept as it is as shown in FIG. 4, and the photoconductors were rotated for two hours at 130 rpm while those as follows were applied to the charging roller, DC voltage: −600V, AC voltage: peak-to-peak value 1250 V, and frequency: 900 Hz.

The individual photoconductor units were set in the black station of Imagio Neo C385, and black halftone images were sequentially output. Images output from the photoconductor units using the protective-agent bars 1-1 to 1-3 were high-quality images. An image output from the photoconductor unit using the protective-agent bar 1-4 was a defective image with streaks.

Example 1-4 and Comparative Example 1-2

All the stations of Imagio Neo C385 were modified so as to be configured as shown in FIG. 1, and the protective-agent bar 1-1 was set in the black station. The protective-agent bar 1-4 was set in a cyan station, and a color chart in which an image area was 5% was formed 5 pieces each, total 50,000 images.

Black halftone images were output, and high-quality images were obtained.

Cyan halftone images were output, but defective images with streaks were found.

Examples 1-5 and 1-6

In Example 1-4, the protective-agent bar 1-2 was set in the black station, and the protective-agent bar 1-3 was set in the cyan station, and a color chart in which an image area was 5% was formed 5 pieces each, total 50,000 images.

Black and cyan halftone images were output, and high-quality images were obtained.

As explained above, according to the first embodiment, by applying an irregular protective agent to an image carrier, it is possible to provide an image forming apparatus capable of outputting high-quality images over a long term without occurrence of defective images due to contamination of the charging roller.

It is also possible to provide a compact image forming apparatus capable of high uniformity of charging potential on the image carrier and with less generation of oxidized gas such as ozone and NOx.

It is further possible to provide an image forming apparatus capable of obtaining stable initial images and stably outputting high-quality images even if images are output over a long term.

It is also possible to suppress deposition of protective agent particles to the charger and prevent damage to the image carrier.

It is further possible to prevent melting of the composition used for the protective-agent bar to maintain the shape of the protective-agent bar.

By the function of adsorbing hydrophilic portions of molecules to hydrophilic portions of the surface of the image carrier and of hydrophobizing the portions after the adsorption, it is possible to maintain the state of avoiding moisture absorption and protect the surface of the image carrier.

It is also possible to resolve the vulnerability of the protective-agent bar to increase generation of particles due to scraping of the protective-agent bar by the brush, to prevent increase in sliding resistance between a latent image carrier and an element used for cleaning the latent image carrier, and to prevent sudden change of potential property on the surface of the image carrier.

A second embodiment of the present invention is explained below.

The inventors of the present invention have studied in detail a protective agent which can be held on a photoconductor (image carrier) and a protective agent which cannot be held thereon to extend the life of the protective agent while the amount of the protective agent to be applied to the photoconductor is increased. The following is found from the study. When the brush is pressed against the protective-agent bar to generate particles of the protective agent and the generated particles are supplied to the photoconductor, the particulate protective agent are deposited on the photoconductor, part of the agent is pressed against the photoconductor by the cleaning blade to be formed as a film which is held on the photoconductor. However, most of the agent is blocked by the cleaning blade, the blocked agent is sent to a waste toner bottle together with waste toner blocked by the cleaning blade, and is discarded. Therefore, it is found that by reducing the amount of the discarded protective agent, the life of the protective-agent bar can be extended.

More specifically, the protective-layer forming device is mounted on the image forming apparatus. In the image forming apparatus, a charger uniformly charges the photoconductor. The latent-image forming device forms a latent image on the surface of the charged photoconductor. A developing unit develops the latent image with the developer containing at least toner to form a toner image on the surface of the photoconductor. A transfer unit transfers the toner image onto a transfer material. A cleaning unit removes residual toner on the surface of the photoconductor after the toner image is transferred. The protective-layer forming device supplies the protective agent to the surface of the photoconductor to form a protective layer to protect the surface of the photoconductor.

The protective-layer forming device includes a unit that supplies the protective agent to the photoconductor by using the protective-agent bar and a brush-type protective-agent supplying element. The protective-agent supplying element supplies the protective agent to the photoconductor so that the amount of whole protective agent contained in the waste toner is 20% or less (preferably 15%, and more preferably 10%) with respect to the total consumption of the protective agent supplied to the photoconductor. The image forming apparatus has the protective-layer forming device in each of the imaging units.

If the amount of whole protective agent contained in the waste toner is 20% or more with respect to the total consumption of the protective agent, it is not preferred because the consuming speed of the protective agent is fast and the protective-agent bar is more frequently replaced as compared with replacement of the photoconductor body. Further, if the large amount of protective agent is contained in the waste toner, this indicates that the protective agent easily moves to any place other than the photoconductor. In other words, the protective agent on the photoconductor moves to the charger (e.g., charging roller), and contaminates the charging roller, which easily causes uneven charging.

The protective-layer forming device is configured to bring the brush, which applies the protective agent, into contact with the protective-agent bar, cause an irregular protective agent to adhere to the end of the brush, and basically supply the irregular protective agent on the end of the brush to the photoconductor via the brush.

To reduce the amount of discarded protective agent and to prevent the protective agent from moving to any place other than the photoconductor, the protective agent is supplied to the photoconductor not in the form of mass or powder but desirably in irregular or film form. Specifically, if the protective agent is supplied to the photoconductor in mass or powder form, most of the protective agent is blocked by the cleaning blade and thrown away to the waste toner bottle. Furthermore, part of the particles of the protective agent supplied to the photoconductor move to the charging roller when passing through under the charging roller, or easily go into the developer when passing through the developing unit. However, the protective agent adhering to the photoconductor in irregular or film form is essentially held on the photoconductor to protect the photoconductor, and thus, this type of protective agent is not blocked by the cleaning blade and discarded nor moves to the charging roller or the developer.

The method of supplying the protective agent not in powder form but in irregular form is implemented in the following manner. The brush is pressed against the protective-agent bar, the protective agent is scraped by the end of the brush to generate powder of the protective agent, the powder is supplied not by dropping on the photoconductor, but the end of the brush brought into contact with the protective-agent bar scrapes the protective agent and the scraped protective agent adheres to the end of the brush in irregular form, and the irregular protective agent adhering thereto moves to or is supplied to the photoconductor through rotation of the brush. The protective agent existing on the photoconductor becomes essentially irregular through these processes, and it is thereby prevented that a large amount of protective agent is blocked and discarded, particles of the protective agent are mixed in the developer, and that a deposition is solidified on the charging roller to cause defective charging.

Furthermore, by supplying an appropriate amount of irregular protective agent to the photoconductor and making the film to be thin by the protective-layer forming mechanism, the protective agent becomes irregular protective film on the photoconductor and is thereby easily held thereon, thus improving more protective effect.

The hardness of the surface of the protective-agent bar is pencil hardness 5B, more preferably, is softer than 6B. If the hardness of the surface of the protective-agent bar is harder than pencil hardness 5B, it is not preferred because the protective agent easily becomes particles upon pressing of the brush against the protective agent, and adheres to the charging roller, which easily causes uneven charging. Moreover, even if the protective agent does not become particles, a hard brush has to be used, which is not preferred because the photoconductor is easily scratched.

Because the protective agent of the photoconductor is used near the photoconductor arranged in the image forming apparatus, the protective agent is often exposed to temperature atmosphere higher than the room temperature under continuous use because of heat generated from a heat source such as a drive system. Therefore, to keep the shape of the protective agent during its use, it is necessary not to cause phase change such as melting of the composition of the protective agent until the temperature reaches a certain temperature.

At the same time, to surely protect the surface of the photoconductor from electrical stress, the protective agent is preferably spread on the surface of the photoconductor to form a protective-agent layer. To employ this configuration, it is preferred that intermolecular interaction of the protective agent component is not too strong.

If the intermolecular interaction is strong, then a large amount of energy is necessary to change an intraphase structure that has been once formed. Therefore, a temperature at which the endothermic peak is generated measured by the Differential Scanning Calorimeter or a differential thermal analyzer becomes high.

Accordingly, to ensure spreading property of the protective agent upon formation of the protective-agent layer while the shape of the protective-agent bar is maintained, the protective agent of the protective-agent bar preferably has at least one endothermic peak temperature in a range of 50° C. to 130° C. It is noted that the endothermic peak temperature indicates a temperature at a position of the endothermic peak in a differential thermal profile upon temperature rise, measured by using a differential thermal analyzer.

The protective-agent bar used for the protective-layer forming device contains an amphiphilic (hydrophilic and hydrophobic) organic matter in the protective agent. The amphiphilic organic matter has both structures indicating hydrophilic property and lipophilic property (hydrophobic property) in one molecule. It is therefore considered that the surface of the photoconductor is protected by the action that the hydrophilic portion in the molecule is adsorbed to the hydrophilic portion on the surface of the photoconductor and the portion is hydrophobized after adsorption.

It is further considered that the hydrophobic structural portion of the adsorbed amphiphilic organic compound and the hydrophobic organic compound are combined due to the intermolecular interaction caused by intermolecular force to form uniform protective-agent layer.

The protective-agent layer formed on the surface of the photoconductor has a hydrophilic portion near the outer-most surface thereof. With this feature, even if many hydrophilic substances are contained in the air near the surface of the photoconductor, these substances are not easily adsorbed to the surface thereof. For example, even under a highly humid use condition, the humidity does not cause the resistance on the surface of the photoconductor to decrease, and charges of an electrostatic latent image can be prevented from being scattered.

After the protective-agent layer is once formed on the surface of the photoconductor, the electrical stresses in the charging process and the transfer process are applied to the protective agent forming the protective-agent layer. Therefore, molecular chains of the protective agent are resulted in cutting, oxidation, or change to hydrophilic property.

The protective agent is partly decomposed by the actions, but the electrical stresses to the photoconductor are significantly reduced and degradation of the photoconductor is suppressed, which allows an extremely long-term use of the photoconductor.

The components of the protective agent degraded due to the electrical stresses are changed to hydrophilic property. However, the degraded components are surrounded by the hydrophilic portions of the amphiphilic organic compound redundantly existing in the protective-agent layer, to be formed in the reverse micelle in the protective-agent layer formed on the surface of the photoconductor. Thus, the protective agent is not affected by the neighboring humidity.

It is important that the amphiphilic organic compound (B) has both a function of adsorption to the surface of the photoconductor and a function of hydrophobizing the surface by taking in the degraded components of the protective agent. When neighboring amphiphilic organic compounds (B) are to be changed to the reverse micelle with the degraded protective agent due to electrical stresses, the setting of the HLB values (value indicating lipophilic property between water and oil of a surfactant: a hydrophile-lipophile balance (HLB) value is important. If the value is set in a range of 1.0 to 6.5, it is preferred because the protective agent can be kept in a more adequately stable state with respect to humidity.

It is preferred to mix the hydrophobic organic compound (A), in addition to the amphiphilic organic compound (B), in the protective agent of the protective-agent bar used for the image forming apparatus. The mixture of the hydrophobic organic compound therein functions as a role of providing flexibility to the protective-agent bar and also of causing the amphiphilic organic compound to easily adhere to the entire surface of the photoconductor. Moreover, because the hydrophobic organic compound is generally soft, the protective-agent bar can be kept softer than the pencil hardness 5B. Therefore, it is preferred because even if the brush of the protective-agent supplying element is pressed against the protective-agent bar, particles of the protective agent are hardly generated, and thus, the protective agent can easily shift to the end of the brush.

The content of the hydrophobic organic compound in the protective agent of the protective-agent bar used for the image forming apparatus is 10 wt % to 97 wt %, preferably, 20 wt % to 90 wt %. If the content of the hydrophobic organic compound is 10 wt % or less, the protective-agent bar becomes vulnerable, and it is not preferred because when the brush is pressed against the protective-agent bar, many particles of the protective agent are easily generated, and the protective agent is hard to adhere to the entire surface of the photoconductor in film form. If the content of the hydrophobic organic compound is 97 wt % or more, it is not preferred because the frictional force between the photoconductor and the cleaning blade increases. The hydrophobic organic compound is not preferred because it is oxidized and decomposed by the energy of charging to be ionic conductive materials and the latent image becomes often blurred. However, if the amphiphilic organic compound is contained by 3 wt % or more, even if the hydrophobic organic compound is oxidized and decomposed to be ionic conductive material, the ionic conductive material is involved by the amphiphilic organic compound, which prevents conductive properties from being imparted to the latent image, and occurrence of blurring thereby largely decreases.

The molecular weight of the hydrophobic organic compound in the protective agent of the protective-agent bar used for the image forming apparatus is preferably 350 to 850 based on a weight-average molecular weight Mw, and more preferably 400 to 800.

Specifically, the examples of the hydrophobic organic compound are explained as above.

Because the protective-agent bar is used near the photoconductor arranged in the image forming apparatus, the protective agent is often exposed to temperature atmosphere higher than the room temperature under continuous use because of heat generated from a heat source such as a drive system. Therefore, to keep the shape of the protective agent during its use, it is necessary not to cause phase change such as melting of the composition of the protective agent until the temperature reaches a certain temperature.

At the same time, to surely protect the surface of the photoconductor from electrical stress, the protective agent is preferably spread on the surface of the photoconductor to form a protective-agent layer. To employ this configuration, it is preferred that intermolecular interaction of the protective agent component is not too strong.

If the intermolecular interaction is strong, then a large amount of energy is necessary to change an intraphase structure that has been once formed. Therefore, a temperature at which the endothermic peak is generated measured by a differential thermal analyzer becomes high.

Accordingly, to ensure spreading property of the protective agent upon formation of the protective-agent layer while the shape of the protective-agent bar is maintained, the protective agent of the protective-agent bar preferably has at least one endothermic peak temperature in a range of 50° C. to 120° C. It is noted that the endothermic peak temperature indicates a temperature at a position of the endothermic peak in a differential thermal profile upon temperature rise, measured by using a differential thermal analyzer.

The image forming apparatus uses a contact or proximity charging system on the surface of the photoconductor and an AC charging system in which the AC voltage is superimposed on the DC voltage. The charging roller or the like is used for the contact or proximity charging system. In the system using the charging roller, oxidized gas such as ozone and NOx is less generated and a large space is not required, and thus, the charging roller is effective in a compact image forming apparatus and a tandem system in which four photoconductors are arranged in a line. Furthermore, by superimposing the AC voltage on the DC voltage, the charging potential of the photoconductor can be stably and uniformly held.

In the image forming apparatus, the protective agent (lubricant) is previously applied to the surface of the photoconductor before it is used. If an appropriate amount of protective agent is applied to the surface while forming an image after the photoconductor is started, it is difficult to uniformly apply the protective agent to the entire surface by a sufficient amount at which the protective agent can bear the AC charging because there are the charging process and toner input process. However, in the system without the charging process, the transfer process, and the developing process, it is comparatively easy to uniformly apply the protective agent to the entire surface by the sufficient amount at which the protective agent can bear the AC charging.

Furthermore, when a portion on the photoconductor where the protective agent is not deposited is applied with AC charging and is thereby once degraded, the protective agent is difficult to be kept on the surface of the photoconductor even if the protective agent is newly applied to the degraded portion after it is degraded. However, even if the protective agent at a portion where the protective agent has been deposited is degraded and removed due to the AC charging, by supplying new protective agent thereto, the surface of the photoconductor is easily coated with the protective agent. Therefore, the photoconductor needs to be uniformly and sufficiently applied with the protective agent in the previous stage before the photoconductor is used. Thereafter, even if the photoconductor is electrically discharged due to the AC charging and the protective agent is supplied while an image is formed, a sufficient amount of protective agent can be uniformly held on the surface of the photoconductor using the protective agent of a less amount of supply than ever before.

The photoconductor before use indicates a photoconductor that does not form even one image.

The image forming apparatus is configured to apply the protective agent to the surface of the photoconductor before the photoconductor is used when the charging unit, the developing unit, and the transfer unit in the device are not in contact with the photoconductor, or to uniformly apply a sufficient amount of protective agent to the surface of the photoconductor in the system without the charging unit, the developing unit, and the transfer unit. With this feature, it is possible to prevent the progress of degradation in the portion where the protective agent is not deposited due to its uneven application and of which degradation is thereby started.

The method of previously applying the protective agent to the photoconductor before it is used includes a method of previously applying the protective agent thereto outside the device, in addition to the method of operating only a unit that applies the protective agent before the photoconductor is used when the charging unit, the developing unit, and the transfer unit in the device are not in operation. The method of supplying the protective agent inside or outside the device includes a method of rotating the brush while it is in contact with the protective-agent bar and the photoconductor, scraping the protective agent with the brush, and supplying the scraped protective agent to the rotating photoconductor through the rotation of the brush. The method also includes a method of rotating the photoconductor while the protective-agent bar is pressed against the photoconductor as it is, and supplying the protective agent to the photoconductor.

The example of the main portion of the imaging unit that includes the protective-layer forming device is as shown in FIG. 1.

As shown FIG. 4, the protective-layer forming device 2 is arranged facing the drum-shaped photoconductor 1 which is the photoconductor. The protective-layer forming device 2 includes the protective-agent bar 21 formed into a bar (e.g., cylinder, quadratic prism, and hexagonal cylinder) that protects the photoconductor, the protective-agent supplying element 22 that has a brush 22*a* in contact with the protective-agent bar 21 and supplies the protective agent moved from the protective-agent bar 21 to the brush 22*a* to the photoconductor 1, the pressing mechanism 23 that presses the protective-agent bar 21 against the brush 22*a* to move the protective agent to the brush 22*a*, and the protective-layer forming mechanism 24 that makes the supplied protective agent to be thin film.

The protective-agent bar 21 is pressed against the brush 22*a* by pressing force from the pressing mechanism 23 formed with a pressing element such as a spring, and the protective agent thereby shifts from the protective-agent bar 21 to the brush 22*a*. The protective-agent supplying element 22 is made to rotate with the rotation of the photoconductor 1 based on a difference in linear velocity between the two so that the end of the brush 22*a* slidably contacts the surface of the photoconductor 1, and during the contact, irregular protective agent held on the surface of the brush 22*a* is applied to the surface of the photoconductor 1.

There is a case where the protective agent supplied to the surface of the photoconductor 1 is not often formed as an adequate protective layer upon supply depending on selection of material types. Therefore, to form more uniform protective layer, the protective agent on the surface of the photoconductor is formed as a thin film by the protective-layer forming mechanism 24 that includes a blade-type element 24*a* and a pressing element 24*b* such as a spring that presses the blade-type element 24*a* against the surface of the photoconductor 1, and the protective agent becomes a protective layer on the surface of the photoconductor 1. An appropriate amount of irregular protective agent is supplied to the photoconductor 1 and the protective agent is formed as a thin film by the protective-layer forming mechanism 24 in the above manner, and the protective agent thereby becomes the irregular protective agent on the photoconductor 1 so that it is easily held thereon. Accordingly, it is possible to realize the image forming apparatus capable of outputting high-quality images over a long term without occurrence of defective images due to contamination of the charger (such as the charging roller) and with a minimum frequency of replacing the consumable components.

The operations, the materials, properties, and setting conditions of the components forming the image forming apparatus are as explained above.

The example of a configuration of the imaging unit (image forming station) using the process cartridge provided in the image forming apparatus is basically as shown in FIG. 2.

The example of a configuration of the image forming apparatus is basically as shown in FIG. 3.

A series of processes to form an image is explained below using a negative-positive process. It is noted that operations of the imaging units are the same as each other, and thus the operation of one imaging unit is explained below.

The drum-type photoconductor (image carrier) 1 can be an organic photo conductor (OPC) having an organic photoconductive layer is decharged by a decharging lamp (not shown), and uniformly charged to negative by the charger 3 having a charging element (e.g., charging roller).

When the photoconductor 1 is charged by the charger 3, a certain amount of voltage appropriate for charging of the photoconductor 1 to a desired potential or a charging voltage obtained by superimposing AC voltage on the voltage is applied from a voltage applying mechanism (not shown) to the charging element.

The charged photoconductor 1 is radiated with a laser beam emitted by the latent-image forming device 8 such as a laser optical system, which includes a plurality of laser light sources, a coupling optical system, and a scanning/image forming optical system, to form a latent image thereon (the absolute value of the potential at an exposed portion is lower than the absolute value of the potential at a non-exposed portion).

The laser beam emitted from the laser light source (e.g., a semiconductor laser) is deflectively scanned by an optical deflector formed with a polygon mirror rotating at high speed, to scan the surface of the photoconductor 1 through the scanning/image forming optical system including a scanning lens and mirrors, in the direction of the rotating axis of the photoconductor 1 (main scanning direction).

The latent image formed in the above manner is developed by a developer formed of toner particles or formed of a mixture of toner particles and carrier particles to form a visible image or a toner image. The developing device 5 includes a developing sleeve 51 which serves as a developer carrier to supply the developer.

When the latent image is to be developed, an appropriate amount of voltage or a developing bias obtained by superimposing AC voltage on the voltage is applied from the voltage applying mechanism (not shown) to the developing sleeve 51.

Each toner image formed on the photoconductor 1 of an imaging unit 10 corresponding to each color is primary-transferred sequentially in a superimposed manner onto the intermediate transfer member 7 by the transfer device 6 as a primary transfer device. On the other hand, a sheet-type transfer material is fed from a sheet-feed cassette selected from multiple-stage sheet-feed cassettes 201*a*, 201*b*, 201*c*, and 201*d* of a sheet-feed unit 200 by a sheet-feed mechanism including a paper pickup roller 202 and a separation roller 203, and is conveyed to a secondary transfer portion through conveying rollers 204, 205, and 206, and through a registration roller 207 by synchronizing timing of sheet-feeding with an image forming operation and a primary transfer operation. At the secondary transfer portion, the toner image on the intermediate transfer member 7 is secondarily transferred onto a conveyed transfer material by a secondary transfer device (e.g., secondary transfer roller) 12. In the transfer processes, it is preferred to apply a potential having inverse polarity to the charging polarity of the toner as a transfer bias to the primary transfer device 6 and the secondary transfer device 12.

After the secondary transfer, the transfer material is separated from the intermediate transfer member 7 to obtain a transferred image. The toner particles remaining on the photoconductor 1 after the primary transfer are collected by the cleaning element 41 of the cleaning device 4 into the toner collecting chamber in the cleaning device 4. The toner particles remaining on the intermediate transfer member 7 after the secondary transfer are collected by an cleaning element of a belt cleaning device 9 into the toner collecting chamber in the belt cleaning device 9.

The image forming apparatus 100 shown in FIG. 3 is a tandem-type image forming apparatus in which the imaging unit 10 is arranged in plurality along the intermediate transfer member 7 and an intermediate transfer system is employed. A plurality of toner images of different colors sequentially formed on photoconductors 1 (1Y, 1M, 1C, 1K) by the imaging units 10 are once sequentially transferred onto the intermediate transfer member 7, and the toner images are collectively transferred as one image onto a transfer material. The transfer material with the toner image thereon is sent to a fixing device 14 by a conveying device 13, and the toner is thermally fixed on the transfer material. The transfer material after the fixture is discharged onto a sheet-discharge tray 17 by a sheet-discharge roller 16 through a conveying device 15.

The image forming apparatus 100 also has a duplex printing function. In duplex printing mode, a conveying path arranged in downstream of the fixing device 14 is switched so that the transfer material with the image fixed on one side thereof is reversed through a conveying device 210 for duplex printing, and the transfer material is again fed to the transfer roller 206 and the registration roller 207. An image is then transferred onto the back side of the transfer material. The transfer material after the image is transferred is conveyed to the fixing device 14 in the above manner, where the image is fixed thereon, and the transfer material with the image fixed thereon is discharged to the sheet-discharge tray 17.

In the configuration, a tandem-type image forming apparatus can be configured to use a direct transfer system without using the intermediate transfer member. When the direct transfer system is used, a transfer belt for carrying a transfer material can be used instead of the intermediate transfer member to obtain a color image in the following manner. A plurality of toner images of different colors are sequentially formed on the photoconductors 1 (1Y, 1M, 1C, 1K) by the imaging units 10 respectively, and the formed toner images are directly and sequentially transferred onto a transfer material conveyed by the transfer belt. The transfer material is sent to the fixing device, where the toner is thermally fixed thereon.

In the image forming apparatus as explained above, the charger 3 is preferably arranged in contact with or close to the surface of the photoconductor. With this feature, the amount of ozone produced upon charging can largely be suppressed as compared with a corona discharger called colotron or scolotron using an electrical-discharge wire.

However, in the charger 3 that charges the charging element when it is in contact with or close to the surface of the photoconductor 1, electrical discharge is performed in an area close to the surface thereof as explained above, and thus electrical stress to the photoconductor 1 tends to increase.

With the protective-layer forming device 2 that uses the protective agent for the photoconductor, the photoconductor can be maintained over the long period of time without degradation. Thus, it is possible to largely suppress variation of images over time or variation of images due to the use environment, and to ensure stable image quality.

The photoconductor used in the image forming apparatus and the details thereof are the same as these of the first embodiment, and explanation thereof is omitted.

The toner used in the image forming apparatus is the same as that of the first embodiment, and explanation thereof is also omitted.

EXAMPLES

Although the present invention is explained in further detail below in the following examples, the present invention is not limited by the examples.

Method of Manufacturing Protective-Agent Bar 2-1

FT 115 (synthetic wax manufactured by NIPPON SEIRO CO., LTD.) of 39 wt. parts and 61 wt. parts of sorbitan tristearate (HLB: 1.5) were put into a glass container with a lid, and stirred and melted by a hot stirrer in which temperature was controlled to 130° C.

The melted composition due to protective-agent formula 2-1 was poured into an aluminum-made die having previously been heated to 83° C. so as to be filled therewith. The die had inner dimensions of 12 mm×8 mm×350 mm. The composition was cooled down to 50° C. in room-temperature atmosphere, and then the composition was again heated up to 60° C. in a temperature-controlled bath in which the temperature was set and was left for 20 minutes at the same temperature, and thereafter, the composition was cooled down to the room temperature.

After cooled down, the solid matter was removed from the die, both ends thereof in the longitudinal direction were cut, the bottom thereof was cut to prepare a 7 mm×8 mm×310 mm-protective-agent bar 2-1, and the weight thereof was measured. A double-stick tape was adhered to the bottom of the protective-agent bar to be fixed to a metal-made support.

A sample (10 mg) was obtained from the protective-agent bar 2-1, and an endothermic peak was measured by using Differential Scanning Calorimeter DSC-60 (manufactured by Shimadzu Corp.). As a result, the endothermic peak was obtained at 52° C.

The surface of the protective-agent bar 2-1 was scratched by a 6B pencil, and a scratch was not found thereon, but when scratched by a 5B pencil, then a scratch was found. Therefore, it is clear that the pencil hardness of the protective-agent bar 2-1 was between 5B and 6B.

Method of Preparing Protective-Agent Bar 2-2

Protective-agent bar 2-2 was prepared in the same manner as that of the protective-agent bar 2-1 except for using 70 wt. parts of normal paraffin (average molecular weight 640) and 30 wt. parts of sorbitan monostearate (HLB: 5.9).

A sample (10 mg) was obtained from the protective-agent bar 2-2, and an endothermic peak was measured by using Differential Scanning Calorimeter DSC-60 (manufactured by Shimadzu Corp.). As a result, the endothermic peaks were obtained at 53° C. and 88° C.

The surface of the protective-agent bar 2-2 was scratched by a 6B pencil, and a scratch was found thereon, Therefore, it is clear that the protective-agent bar 2-2 was softer than 6B.

Method of Preparing Protective-Agent Bar 2-3

A protective-agent bar 2-3 was prepared using a method similarly to the method of preparing the protective-agent bar 2-1 except for using 73 wt. parts of normal paraffin (average molecular weight 640) and 27 wt. parts of glyceryl monostearate (HLB: 3.5).

The surface of the protective-agent bar 2-3 was scratched by a 6B pencil, and a scratch was found thereon. Therefore, it is clear that the protective-agent bar was softer than 6B.

A sample (10 mg) was obtained from the protective-agent bar 2-3, and an endothermic peak was measured by using Differential Scanning Calorimeter DSC-60 (manufactured by Shimadzu Corp.). As a result, the endothermic peaks were obtained at 53° C. and 88° C.

Method of Preparing Protective-Agent Bar 2-4

A protective-agent bar 2-4 was prepared using a method similarly to the method of preparing the protective-agent bar 2-1 except for using only zinc stearate for the protective agent and putting the zinc stearate into a glass container with a lid and melting it while stirring by a hot stirrer in which the temperature was controlled to 165° C.

The surface of the protective-agent bar 2-4 was scratched by a 4B pencil, but no scratch was found thereon. However, a scratch was found when it was scratched by a 2B pencil. As a result, it is clear that the hardness of the surface of the protective-agent bar 2-4 was between pencil hardness 4B and 2B.

Examples 2-1, 2-2, 2-3, and Comparative Example 2-1

An undercoat layer, a charge generation layer, a charge transport layer, and a protective layer were applied in this order to an aluminum drum (conductive support) having a diameter of 30 millimeters, and were dried to prepare a photoconductor including a undercoat layer of 3.6 micrometers, a charge generation layer of about 0.14 micrometer, a charge transport layer of 23 micrometers, and a protective layer of about 3.5 micrometers. It is noted that the protective layer was applied by a spray method while the other layers were applied by a dip coating method. The same formula as that of alumina having an average particle size of 0.18 micrometer was added by 23.8 mass % to the charge transport layer was used for the protective layer.

Photoconductors and the protective-agent bars 2-1, 2-2, 2-3, and 2-4 as the photoconductor 1 and the protective-agent bar 21 were respectively set in photoconductor units for black each configured as shown in FIG. 4 using the tandem-type color image forming apparatus (Imagio Neo C385 manufactured by RICOH COMPANY, LTD), and four types of photoconductor units were prepared. The photoconductor units in which the protective-agent bars 2-1, 2-2, and 2-3 were set are explained as Examples 2-1, 2-2, and 2-3, respectively, and the photoconductor in which the protective-agent bar 2-4 was set is explained as Comparative Example 2-1.

Next, the photoconductor units were not incorporated in the image forming apparatus and not charged, and the photoconductors were rotated for 10 minutes at 130 rpm and only the protective agent was applied to the photoconductors.

Each surface of the photoconductors under the charger after the protective agent of the protective-agent bars 2-1, 2-2, and 2-3 were applied thereto was observed by using an electron microscope, and then it was found based on three-field observation that the number of particles of the protective agent of the protective-agent bar 2-1 was 5 to 12/mm$^2$, and each number of particles of the protective agent of the protective-agent bars 2-2 and 2-3 was only 0 to 2/mm$^2$.

The surface of the photoconductor under the charger after the protective agent of the protective-agent bar 2-4 was applied thereto was observed by using the electron microscope, and then many particles of the protective agent were observed. Therefore, the number of particles existing per mm$^2$ was counted for three fields, and as a result, the average number was 603/mm$^2$.

As for the photoconductor after the protective agent of the protective-agent bar 2-2 was applied thereto, a deposition on the surface of the photoconductor was scraped by using KBr and was analyzed by FT-IR using a KBr method. As a result, peaks derived from normal paraffin and sorbitan monostearate were detected, and thus, it is found that the protective agent of the protective-agent bar 2-2 was deposited on the photoconductor in irregular or film form.

After the observation and analysis, the photoconductor units were not incorporated in the image forming apparatus but the configuration was kept as it is as shown in FIG. 4, and the photoconductors were rotated for two hours at 130 rpm while those as follows were applied to the charging roller, DC voltage: −600V, AC voltage: peak-to-peak value 1250 V, and frequency: 900 Hz.

The individual photoconductor units were set in the image forming station for black of the tandem-type color image forming apparatus (Imagio Neo C385 manufactured by RICOH COMPANY, LTD), and black halftone images were sequentially output. Images output from the photoconductor units using the protective-agent bars 2-1 to 2-3 according to Examples 2-1 to 2-3 were high-quality images. An image output from the photoconductor unit using the protective-agent bar 2-4 according to Comparative Example 2-1 had a thin streak.

Example 2-4 and Comparative Example 2-2

The image forming stations of all the colors of the tandem-type color image forming apparatus (Imagio Neo C385 manufactured by RICOH COMPANY, LTD) were modified so as to be configured as shown in FIGS. 1 and 2. As Example 2-4, the photoconductor unit with the protective-agent bar 2-1 set therein was incorporated in the image forming station for black.

As Comparative Example 2-2, the photoconductor unit with the protective-agent bar 2-4 set therein was incorporated in the image forming station for cyan. A color chart in which an image area was 5% was formed 5 pieces each, total 10,000 images.

Black halftone images were output, and high-quality images were obtained, and then cyan halftone images were output, but defective images with streaks were obtained.

The weight of the protective-agent bar after the image was output was measured, and the weight before the image was output was subtracted from the measured weight, to calculate each consumption of the protective agents about the protective-agent bar 2-1 (photoconductor unit for black) and the protective-agent bar 2-4 (photoconductor unit for cyan).

The waste toner in a toner bottle was treated by a solvent and was analyzed by GC-MS (GCMS-QP 5000: manufactured by Shimadzu Corp.), to calculate the amount of protective agent in the toner bottle based on the peak derived from sorbitan tristearate. From the analysis, the amount of whole protective agent contained in the waste toner with respect to the total consumption of the protective agent was calculated as 15%.

Zinc determination in the waste toner in a cyan toner bottle was performed by using inductively coupled plasma emission spectroscopy (ICP), to calculate the amount of zinc stearate and also calculate the amount of whole protective agent contained in the waste toner with respect to the total consumption of the protective agent. As a result, the amount was 34%.

Examples 2-5, 2-6, and Comparative Example 2-3

The protective-agent bar 2-2, instead of the protective-agent bar 2-1 in Example 2-4, was set in a photoconductor unit, and the photoconductor unit was incorporated in the image forming station for black, which was explained as Example 2-5. The protective-agent bar 2-3 was set in a photoconductor unit, and the photoconductor unit was incorporated in the image forming station for cyan, which was explained as Example 2-6. The protective-agent bar 2-4 was set in a photoconductor unit, and the photoconductor unit was incorporated in the image forming station for magenta, which was explained as Comparative Example 2-3. A color chart in which an image area was 5% was formed 5 pieces each, total 50,000 images.

After 50,000 images were formed, black and cyan halftone images were output, and high-quality images were obtained. However, magenta halftone images were output, but a belt-shaped background stain was found. Moreover, the protective-agent bar 2-4 was taken out from the photoconductor unit for magenta, and the thickness thereof decreased to half or less of its original thickness.

The weight of the protective-agent bar after the image was output was measured, and the weight before the image was output was subtracted from the measured weight, to calculate each consumption of the protective agents about the protective-agent bar 2-2 (photoconductor unit for black), the protective-agent bar 2-3 (photoconductor unit for cyan), and the protective-agent bar 2-4 (photoconductor unit for magenta).

Each waste toner in toner bottles for black and cyan was treated by a solvent and was analyzed by GC-MS (GCMS-QP 5000: manufactured by Shimadzu Corp.), to calculate each amount of protective agents in the toner bottles based on the peak derived from sorbitan tristearate. From the analysis, the amount of whole protective agent contained in the waste toner with respect to the total consumption of the protective agent was 3% for the photoconductor unit for black, while the amount thereof was 6% for the photoconductor unit for cyan.

Zinc determination in mixed substance in a magenta toner bottle was performed by using ICP, to calculate the amount of zinc stearate and also calculate the amount of whole protective agent contained in the waste toner with respect to the total consumption of the protective agent. As a result, the amount was 31%.

Therefore, according to the second embodiment, it is configured to provide a unit that supplies the protective agent to the image carrier by using the protective-agent bar and a brush-type protective-agent supplying element. The protective-agent supplying element supplies the protective agent to the image carrier so that the amount of protective agent contained in the waste toner is 20% or less of the total consumption of protective agent supplied to the image carrier. The protective-layer forming device causes the brush of the protective-agent supplying element to apply the protective agent and the protective-agent bar to be brought into contact with each other, causes the irregular protective agent to adhere to the end of the brush, to basically supply the irregular protective agent adhering to the end of the brush to the image carrier through the brush.

As explained above, by specifying the amount of the protective agent to be supplied to the image carrier, the amount of the protective agent on the image carrier can be appropriately kept, and thus, unnecessary consumption of the protective agent can be reduced. Furthermore, by supplying an appropriate amount of irregular protective agent to the image carrier and making the film of the protective agent to be thin by the protective-layer forming mechanism, the protective agent becomes irregular protective film on the image carrier and is thereby easily held thereon. Accordingly, it is possible to realize the image forming apparatus capable of outputting high-quality images over a long term without occurrence of defective images due to contamination of the charger (such as the charging roller) and with a minimum frequency of replacing the consumable components.

The protective-agent bar used in the protective-layer forming device is formed of the bar-type protective agent, and the hardness of the surface of the protective layer is softer than the pencil hardness 5B. Therefore, the protective-agent bar which causes protective agent particles to hardly exist on the image carrier can be realized.

The protective agent of the protective-agent bar has at least one endothermic peak temperature in a range of 50° C. to 130° C. Therefore, the protective agent is easily deposited on the image carrier in film form, and the protective-agent bar having high protective effect of the image carrier can be realized.

Furthermore, in the protective-agent bar, the amphiphilic (hydrophilic and hydrophobic) organic matter is contained in the protective agent. The HLB value of the amphiphilic organic matter in the protective agent is set in a range of 1.0 to 6.5. Further, the amphiphilic organic matter in the protective agent is a nonionic surfactant. With these features, the protective-agent bar having high protective effect of the image carrier can be realized.

In the protective-agent bar, the amphiphilic organic matter and the hydrophobic organic matter are contained in the protective agent. The hydrophobic organic matter contained in the protective agent is paraffin. Furthermore, a weight ratio A/B of the hydrophobic organic compound (A) and the amphiphilic organic compound (B) contained in the protective agent is set in a range of 10/90 to 97/3. With these features, it is possible to realize the protective-agent bar that causes protective agent particles to hardly exist on the image carrier, causes the protective agent to be easily deposited on the image carrier in film form, and has high protective effect of the image carrier.

According to this embodiment, the protective-layer forming device using the protective-agent bar is provided in the imaging unit, and the protective layer can be formed on the image carrier by supplying an appropriate amount of protective agent thereto and forming thin film thereon. Accordingly, it is possible to realize the image forming apparatus capable of outputting high-quality images over a long term without occurrence of defective images due to contamination of the charger (such as the charging roller) and with a minimum frequency of replacing the consumable components.

The charger superimposes a DC voltage on an AC voltage to be applied to the charging element and thereby charges the image carrier. Thus, it is possible to realize a compact image forming apparatus having high uniformity of a charging potential on the image carrier and less generation of oxidized gas such as ozone and NOx.

Further, the image carrier is previously applied with the protective agent, or the image carrier is applied with the protective agent before it is used when the charging unit, the developing unit, and the transfer unit are not in contact with the image carrier in the device. By using such an image carrier, it is possible to realize the image forming apparatus capable of obtaining stable initial images and stably outputting high-quality images even if images are output over a long term.

Furthermore, a plurality of imaging units is arranged in line, and a plurality of toner images of different colors are sequentially formed by the imaging units. The toner images of the colors are superposedly transferred onto a transfer material, and a multicolor or full-color image is formed thereon. Accordingly, it is possible to realize the image forming apparatus capable of outputting high-quality multicolor or full-color images over a long term without occurrence of defective images and with a minimum frequency of replacing the consumable components.

The process cartridge is obtained by incorporating the image carrier and the protective-layer forming device, and at least one of the charger, the developing unit, and the cleaning unit in a cartridge, all of which forms the imaging unit of the image forming apparatus. With this feature, it is possible to realize the process cartridge with the image carrier and the consumable components of which lives are extended. Besides that, by using the process cartridge, it is possible to realize the image forming apparatus capable of maintaining long life of the process cartridge and forming high-quality images.

A third embodiment of the present invention is explained below.

Figure 5:
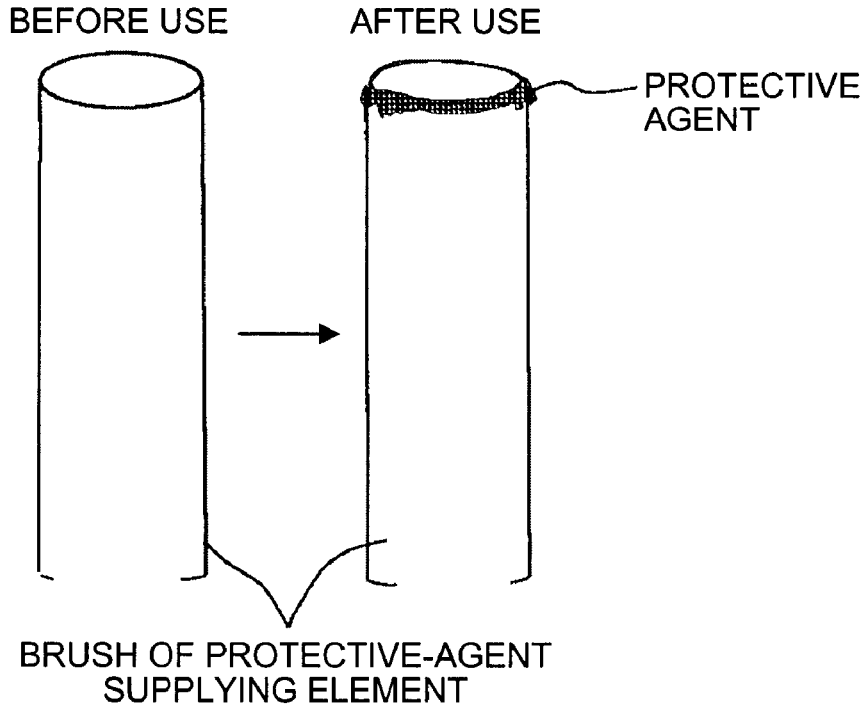
FIG. 5 is a schematic diagram for explaining how a protective agent is deposited on a cylindrical brush of a protective-agent supplying element according to a third embodiment.
Figure 6:
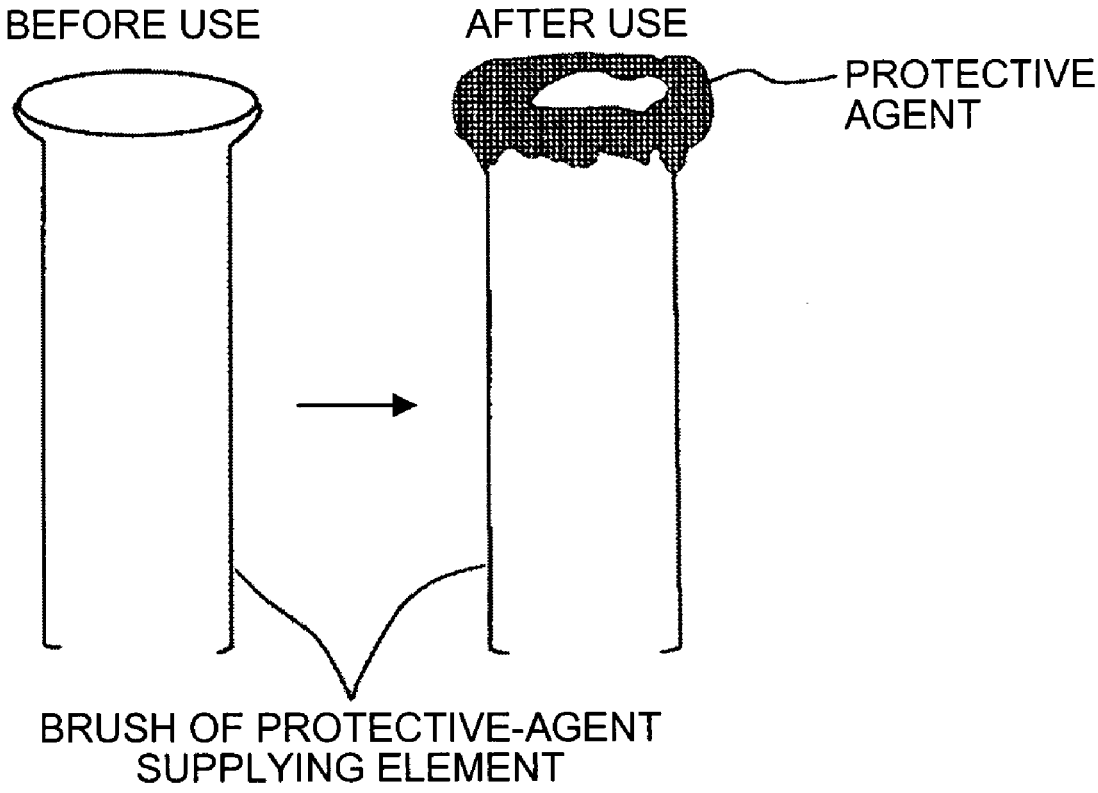
FIG. 6 is a schematic diagram for explaining how a protective agent is deposited on a cylindrical brush of the protective-agent supplying element with a flat end wider than the cross section of the brush.

The inventors of the present invention conducted experiments on how quickly a protective agent is supplied to an image carrier such as a photoconductor in an early stage of image formation in the image forming apparatus that includes a soft protective-agent bar used for forming a protective layer. In the experiments, the end of a brush of the protective-agent supplying element having the brush for use in supply of the protective agent was observed in detail. It was found that a place where the protective agent existed was mainly a periphery of the end of the cylindrical brush as shown in FIG. 5. Therefore, the inventors thought that if the place where the protective agent could be present could be provided on the end of the brush, then the protective agent could be supplied quickly to the image carrier, and continued further examination on the end shape of the brush. As a result, as shown in FIG. 6, it was found that by making the end of the brush flat to widen the area of the end of the brush than the cross section of the brush, the protective agent efficiently adhered to the end of the brush, which enabled smooth supply of the protective agent to the image carrier.

More specifically, the protective-agent bar, obtained by forming a comparatively soft protective agent into a bar, is used to form the protective layer to protect the image carrier in the image forming apparatus, and to supply the image carrier with the protective agent moved from the protective-agent bar to the brush. Specifically, the brush is provided in the protective-agent supplying element and comes in contact with the protective-agent bar. The protective-agent supplying element is configured so that the area of the end of the brush is made larger by 5% to 100% than the cross section of the brush at a position 50 micrometers from the end of the brush. In addition, the protective-agent supplying element is configured so that a distance from a place where an outer diameter of the end of the brush is the largest to a front edge of the brush in the longitudinal direction is 40 micrometers or less. Furthermore, the protective-agent bar to supply the protective agent to the brush of the protective-agent supplying element is formed of a bar-type protective agent, and the hardness of the protective agent at 25° C. is set to be softer than pencil hardness 4B.

The protective-layer forming device includes the protective-agent supplying element and the protective-agent bar. The protective-layer forming device supplies the protective agent to the image carrier by pressing the protective-agent bar against the brush of the protective-agent supplying element, causing the protective agent to be shifted to the brush, and pressing the brush with the protective agent thereon against the image carrier.

The process cartridge incorporates at least the image carrier and the protective-layer forming device in the cartridge.

The image forming apparatus includes at least the image carrier and the protective-layer forming device, and can also include the process cartridge.

It is noted that the image forming apparatus, the image carrier, the process cartridge, and toner used for these devices according to the third embodiment are basically the same as those explained above, and the detailed explanation thereof is omitted.

The protective-agent supplying element includes the brush coming in contact with the protective-agent bar, and supply the protective agent shifted from the protective-agent bar to the brush to the image carrier. The area of the end of the brush is made larger by 5% to 100%, preferably 10% to 80%, and more preferably 15% to 60% than the cross section of the brush at a position of 50 micrometers from the end of the brush.

If the area of the end of the brush is smaller than 5% with respect to the cross section of the brush at a position 50 micrometers from the end of the brush, it is not preferred because the amount of holding the protective agent is not much different from that of a cylindrical brush and the speed of the supply of the protective agent to the image carrier is slow. If larger than 100%, it is not preferred because brush fibers are easily entangled with each other and the end of the brush easily cracks. The end of the brush is not necessarily perfectly flat, and may be irregular, curved, or inclined. However, a length from a place where the outer diameter of the end of the brush is the largest to the front edge of the brush in the longitudinal direction is 40 micrometers or less, preferably 35 micrometers or less, and more preferably 30 micrometers or less.

The portion of the brush to which a large amount of protective agent adheres is around the place where the outer diameter of the brush is the largest. Therefore, if the distance from the place where the outer diameter of the end of the brush is the largest to the front edge of the brush in the longitudinal direction is 40 micrometers or more, it is not preferred because the amount of the protective agent to contact the image carrier is reduced when the brush is in contact with the image carrier. If the end of the brush is not perfectly flat, then the area equivalent to the place of the end of the brush where the outer diameter is the largest is used.

The brush of the protective-agent supplying element is made of fibers with high durability and flexibility, and excellent in wear resistance and slidability. The fibers satisfy these conditions include regenerated fibers such as rayon fibers and cupra fibers and synthetic fibers formed from nylon, acryl, polypropylene, and polyester. In the third embodiment, the rayon fibers are used because of excellent flexibility, desired slidability, and low cost.

It is further preferred that the brush of the protective-agent supplying element is conductive. The method of imparting conductive properties to the fibers includes a method of kneading conductive substances into original yarns. The method also includes a method of coating the surfaces of fibers after fiber spinning by a working fluid containing conductive substances. In the third embodiment, the method of kneading the conductive substances into original yarns is employed because the method has an advantage in that the fibers maintain conductive properties.

Examples of the conductive substance include fine particles of metal such as silver, copper, and nickel, metal compounds such as zinc oxide and tin oxide, and carbon. In the third embodiment, carbon is used because it has stable conductive properties and is low cost.

In addition, as the fibers forming the brush of the protective-agent supplying element, fibers having heat resistance are more preferable. A method of providing the heat resistance to the fibers includes a method of kneading a fire retardant into original yarns and a method of impregnating fibers with a working fluid containing a fire retardant after fiber spinning. In the third embodiment, the method of kneading the fire retardant into the original yarns is employed because the method is easy in operation and can handle various materials of fibers.

Examples of the fire retardant include a halogen fire retardant such as halogenated diol and halogenated glycidyl ether; and a phosphorous fire retardant such as phosphoric ester and phosphorus-nitrogen compounds. In the third embodiment, the phosphorous fire retardant is used as the fire retardant.

The protective-layer forming device used for the image forming apparatus includes the protective-agent supplying element and the protective-agent bar. The protective-layer forming device supplies the protective agent to the image carrier by pressing the protective-agent bar against the brush of the protective-agent supplying element, causing the protective agent to be shifted to the brush, and pressing the brush with the protective agent thereon against the image carrier. The hardness at 25° C. of the surface of the protective-agent bar used for the protective-layer forming device should be softer than pencil hardness 4B, preferably 5B, and more preferably 6B. If the hardness of the surface of the protective-agent bar is harder than pencil hardness 4B, it is not preferred because the protective agent easily becomes particles upon pressing of the brush against the protective agent and the particles adhere to the charging roller, which easily causes uneven charging. Moreover, even if the protective agent does not become particles, a hard brush has to be used, which is not preferred because the image carrier is easily scratched.

The protective agent used for the protective-layer forming device contains hydrophobic substance of 50 wt % or more, preferably 60 wt % or more, and more preferably 70 wt % to 90 wt %. The hydrophobic substance such as the hydrophobic organic compound (A) is preferred because the compound has capabilities to reduce the frictional force between the image carrier and the cleaning blade by applying this compound to the image carrier, to prevent oxidation of the image carrier due to charging, and to maintain high surface resistivity of the image carrier even under high humidity.

If the hydrophobic organic compound (A) in the protective agent is less than 50 wt %, it is not preferred because the surface resistivity of the image carrier decreases under high humidity and image density may easily decrease.

Examples of the hydrophobic organic compound (A) used for the protective agent include a hydrocarbon group which is classified into aliphatic saturated hydrocarbon, aliphatic unsaturated hydrocarbon, alicyclic saturated hydrocarbon, alicyclic unsaturated hydrocarbon, and aromatic hydrocarbon. In addition to the hydrocarbon group, the examples also include fluororesin and a fluoro wax group such as polytetrafluoroethylene (PTFE), polyperfluoroalkylether (PFA), perfluoroethylene-perfluoropropylene copolymer (FEP), polyvinylidene fluoride (PVdF), ethylene-tetrafluoroethylene copolymer (ETFE); and silicone resin and a silicone wax group such as polymethylsilicone and polymethylphenylsilicone.

Among the examples, the aliphatic saturated hydrocarbon is highly preferred because it hardly remains on the image carrier as oxide which increases the frictional force between the image carrier and the cleaning blade and reduces the surface resistivity of the image carrier even if it is oxidized in the charging process. Moreover, the aliphatic saturated hydrocarbon is extremely preferred because it is economically inexpensive.

It is also preferred that the hydrophobic organic compound (A) and the amphiphilic (hydrophilic and hydrophobic) organic matter (B) are contained in the protective agent. The content of the amphiphilic organic matter in the protective agent is 3 wt % to 50 wt %, preferably 5 wt % to 40 wt %, and more preferably 7 wt % to 35 wt %.

In the protective-agent bar, it is preferred that the HLB value of the amphiphilic organic matter in the protective agent is set in a range of 1.0 to 6.5. It is further preferred that the amphiphilic organic matter in the protective agent is nonionic surfactant. It is further preferred that the protective agent contains the hydrophobic organic compound (A) and the amphiphilic organic matter (B).

In the protective-agent bar, it is further preferred that the weight ratio A/B of the hydrophobic organic compound (A) and the amphiphilic organic matter (B) contained in the protective agent is from 50/50 to 97/3, more preferably from 60/40 to 95/5. It is further preferred that the hydrophobic organic compound (A) contained in the protective agent is paraffin as explained above. It is further preferred that the protective agent has at least one endothermic peak temperature in a range of 50° C. to 130° C.

The protective-agent bar used in the protective-layer forming device is basically the same as explained above, and thus, the same explanation is not repeated.

The content of hydrophobic organic compound in the protective agent of the protective-agent bar used for the image forming apparatus contains 50 wt % or more, preferably 60 wt % or more, and more preferably 70 wt % to 90 wt %. If the content of the hydrophobic organic compound is less than 50 wt %, it is not preferred because the protective-agent bar becomes vulnerable, and when the brush is pressed against the protective-agent bar, many particles of the protective agent are easily generated, and the protective agent is difficult to adhere to the entire surface of the image carrier in film form. Moreover, if the hydrophobic organic compound in the protective agent is less than 50 wt %, it is not preferred because the surface resistivity of the image carrier decreases under high humidity and image density may easily decrease.

On the other hand, if the content of the hydrophobic organic compound is 97 wt % or more, it is not preferred because the frictional force between the image carrier and the cleaning blade increases. It is also not preferred because the hydrophobic organic compound is oxidized and decomposed by the energy of charging to be an ionic conductive material which often causes the latent image to blur. However, if the amphiphilic organic compound (B) is contained by 3 wt % or more, even if the hydrophobic organic compound is oxidized and decomposed to be an ionic conductive material, the ionic conductive material is involved by the amphiphilic organic compound, which prevents the conductive properties from being imparted to the latent image, and occurrence of blurring thereby largely decreases.

The molecular weight of the hydrophobic organic compound in the protective agent of the protective-agent bar used in the image forming apparatus is preferably from 350 to 850 based on the weight-average molecular weight Mw, and more preferably from 400 to 800.

Specific examples of the hydrophobic organic compound are as explained above, and thus, the same explanation is not repeated.

As a method of molding the protective-agent bar in a specific shape such as quadratic prism and cylinder, any one of known methods as a solid-material molding method can be used.

Examples of the method include a melting molding method, a powder molding method, a thermal pressing molding method, a cold isotropic pressing method (CIP), and a hot isotropic pressing method (HIP). However, the method is not limited by these examples.

A specific molding method of a protective-agent bar is explained below by using the melting molding method as an example. A predetermined amount of protective agent having been heated and melted is poured into a predetermined-shaped mold form which has previously been heated up to a melting temperature or higher of the protective agent, and the protective agent in the mold form is kept as it is for a certain time at a temperature of a melting point or higher according to need, and thereafter, the protective agent is cooled down using a method of "standing to cool" or "cool removal", to obtain a molded element. To remove inner distortion of the molded element, the cooling is progressing to the temperature below a phase transition temperature of the component of the protective agent during the cooling, and then the molded element may be slowly heated again to a temperature of the phase transition temperature or higher.

After cooled down to a temperature near the room temperature, the molded element is removed from the mold form, to obtain the molded element (protective-agent bar) of the protective agent. Thereafter, the shape of the protective-agent bar may be further arranged by cutting machining.

The mold form is preferably a metal mold form such as steel material, stainless steel (SUS), and aluminum in view of better thermal conductive properties and better dimensional accuracy. The wall of the mold form is preferably coated with a release agent such as fluororesin or silicone resin to improve releasing properties.

Examples of the method of providing a step in the protective-agent bar include a method of previously providing a step in a mold form, a method of pressing a mold with the step against a molded protective-agent bar while heating as required, a method of pressing a heated metal wire or the like against the molded protective-agent bar, a method of radiating a laser beam, and a method of mechanically forming the step. However, the method of previously providing the step in the mold form is the most preferred because the productivity is high and the step can be surely formed.

The details of the image forming apparatus, the protective-layer forming device, the image carrier, and the toner according to the third embodiment are as explained above, and therefore, the same explanation is not repeated.

EXAMPLES

The present invention is explained in further detail below using specific examples, however, the present invention is not limited by the following examples.

Method of Manufacturing Protective-Agent Bar 3-1

Normal paraffin (average molecular weight 640) of 72 wt. parts and sorbitan monostearate (HLB: 5.9) of 28 wt. parts were put into a glass container with a lid, and stirred and melted by a hot stirrer in which temperature was controlled to 120° C.

The melted composition due to protective-agent formula 3-1 was poured into an aluminum-made die having previously been heated to 83° C. so as to be filled therewith. The die had inner dimensions of 12 mm×8 mm×350 mm. The composition was cooled down to 50° C. in room-temperature atmosphere, and then the composition was again heated up to 60° C. in a temperature-controlled bath in which the temperature was set and was left for 20 minutes at the same temperature, and thereafter, the composition was cooled down to the room temperature.

After cooled down, the solid matter was removed from the die, and a rhombic protrusion was formed in the protective-agent bar that contacts one side of the die where a rhombic groove was formed. This side is made upside, and both ends thereof in the longitudinal direction were cut, the bottom thereof was cut to prepare a 7 mm×8 mm×310 mm-protective-agent bar 3-1. A double-stick tape was adhered to the bottom of the protective-agent bar 3-1 to be fixed to a metal-made support.

The surface of the protective-agent bar 3-1 was scratched by a 6B pencil, and a scratch was found thereon. Therefore, it is clear that the protective-agent bar 3-1 was softer than 6B.

A 10-mg sample was obtained from the protective-agent bar 3-1, and an endothermic peak was measured by using Differential Scanning Calorimeter DSC-60 (manufactured by Shimadzu Corp.). As a result, the endothermic peaks were obtained at 53° C. and 88° C.

Method of Preparing Protective-Agent Bar 3-2

A protective-agent bar 3-2 was prepared using a method similarly to the method of preparing the protective-agent bar 3-1 except for using only zinc stearate for the protective agent and putting the zinc stearate into a glass container with a lid and melting it while stirring by a hot stirrer in which the temperature was controlled to 165° C. The surface of the protective-agent bar 3-2 was scratched by a 4B pencil, but a scratch was not found thereon. However, a scratch was found when it was scratched by a 2B pencil. As a result, it is clear that the hardness of the surface of the protective-agent bar 3-2 was between pencil hardness 4B and 2B.

Brush of Protective-Agent Supplying Element

As the brush of the protective-agent supplying element, brushes were prepared by pressing the edge part of polyester fibers against a heated metal plate to plant the edge part of the fibers so that individual areas of the edge parts of the brushes were larger on average by 0%, 8%, 26%, 64%, 87%, and 140% than the cross-section area of the brush at a position 50 micrometers from the end of the brush.

Examples 3-1, 3-2, and Comparative Example 3-1

An undercoat layer, a charge generation layer, a charge transport layer, and a protective layer were applied in this order to an aluminum drum (conductive support) having a diameter of 30 millimeters, and were dried to prepare a photoconductor including a undercoat layer of 3.6 micrometers, a charge generation layer of about 0.14 micrometer, a charge transport layer of 23 micrometers, and a protective layer of about 3.5 micrometers. It is noted that the protective layer was applied by a spray method while the other layers were applied by a dip coating method. The same formula as that of alumina having an average particle size of 0.18 micrometer was added by 23.8 mass % to the charge transport layer was used for the protective layer.

The photoconductor and the protective-agent bar 3-1 prepared in the above manner were set as the photoconductor 1 and the protective-agent bar 21 of the photoconductor unit for black configured as shown in FIG. 4 in the tandem-type color image forming apparatus (Imagio Neo C385 manufactured by RICOH COMPANY, LTD). The respective brushes were used as the brush 22*a*. The individual areas of the edge parts of the brushes were larger on average by 0% (Comparative Example 3-1), 8% (Example 3-1), and 26% (Example 3-2) respectively than the cross-section area of the brush at the position 50 micrometers from the end of the brush. The photoconductor units using the brushes were not incorporated in the image forming apparatus, and the photoconductor 1 was rotated for 60 minutes at 130 rpm while those as follows were applied to the charging roller 3, DC voltage: −600V, AC voltage: peak-to-peak value 1250 V, and frequency: 900 Hz.

Individual photoconductor units were set in the image forming station for black of the tandem-type color image forming apparatus (Imagio Neo C385 manufactured by RICOH COMPANY, LTD), and black halftone images were output. As a result, high-quality images were obtained from the photoconductor units using the brushes, as the brush 22*a*, of which areas of the edge parts were larger on average by 8% (Example 3-1) and 26% (Example 3-2) than the cross-sectional area of the brush at the position 50 micrometers from the end of the brush. The brush as the brush 22*a* of which area of the edge part was larger on average by 0% (Comparative Example 3-1) than the cross-sectional area of the brush at the position 50 micrometers from the end of the brush was set in the photoconductor unit, and images of the photoconductor unit were output. Although the images were not actually defective images, part of images showed "flowing" as a result of observation of the images with a magnifying glass.

The photoconductor units of Example 3-1 and Comparative Example 3-1 were taken out from the image forming apparatus, and the photoconductor was further rotated for 60 minutes at 130 rpm while those as follows were applied to the charging roller 3, DC voltage: −600V, AC voltage: peak-to-peak value 1250 V, and frequency: 900 Hz.

The individual photoconductor units were set in the image forming station for black of the tandem-type color image forming apparatus (Imagio Neo C385 manufactured by RICOH COMPANY, LTD), and black halftone images were output. As a result, high-quality images were obtained from the photoconductor unit according to Example 3-1, but "flowing" was visually observed on part of images of the photoconductor unit according to Comparative Example 3-1.

Comparative Example 3-2

In the same manner as above except for using the protective-agent bar 3-2 instead of the protective-agent bar 3-1 of the photoconductor unit according to Example 3-1, the photoconductor was further rotated for 120 minutes at 130 rpm while those as follows were applied to the charging roller 3, DC voltage: −600V, AC voltage: peak-to-peak value 1250 V, and frequency: 900 Hz. The photoconductor unit was set in the image forming station for black of the tandem-type color image forming apparatus (Imagio Neo C385 manufactured by RICOH COMPANY, LTD), and black halftone images were output. As a result, a large number of images with black streaks thereon were obtained.

Method of Manufacturing Protective-Agent Bar 3-3

A protective-agent bar 3-3 was prepared in the similar manner as that of the protective-agent bar 3-1 except for using 55 wt. parts of microcrystalline wax (average molecular weight 700) and 45 wt. parts of sorbitan tristearate (HLB: 1.5).

The surface of the protective-agent bar 3-3 was scratched by a 6B pencil, and a scratch was found thereon. Therefore, it is clear that the protective-agent bar 3-3 was softer than 6B.

A 10-mg sample was obtained from the protective-agent bar 3-3, and an endothermic peak was measured by using Differential Scanning Calorimeter DSC-60 (manufactured by Shimadzu Corp.). As a result, the endothermic peaks were obtained at 56° C. and 95° C.

Method of Manufacturing Protective-Agent Bar 3-4

A protective-agent bar 3-4 was prepared in the similar manner as that of the protective-agent bar 3-1 except for using 71 wt. parts of normal paraffin (average molecular weight 640) and 29 wt. parts of glyceryl monostearate (HLB: 3.5).

The surface of the protective-agent bar 3-4 was scratched by a 6B pencil, and a scratch was found thereon. Therefore, it is clear that the protective-agent bar 3-4 was softer than 6B.

A 10-mg sample was obtained from the protective-agent bar 3-4, and an endothermic peak was measured by using Differential Scanning Calorimeter DSC-60 (manufactured by Shimadzu Corp.). As a result, the endothermic peaks were obtained at 53° C. and 88° C.

Example 3-3 and Comparative Example 3-3

The image forming station for black of the tandem-type color image forming apparatus (Imagio Neo C385 manufactured by RICOH COMPANY, LTD) was modified so as to be the configuration as shown in FIG. 1 (or FIG. 2) and the protective-agent bar 3-3 was set therein (Example 3-3). The protective-agent bars prepared in the method of manufacturing the protective-agent bar 3-2 were set in the stations for the other colors (Comparative Example 3-3). The brush of which area of the edge part was larger on average by 64% than the cross-sectional area of the brush at the position 50 micrometers from the end of the brush was used for the brush 22*a* in each station.

In the image forming apparatus, a color chart in which an image area was 5% was formed 5 pieces each, total 50,000 images. Black halftone images were output, and high-quality images were obtained. Cyan and magenta halftone images were output, but defective images with streaks were found on both of the images.

Example 3-4

The image forming stations for all the colors were modified so as to be the configuration as shown in FIG. 1 (or FIG. 2) similarly to Example 3-3, and the protective-agent bar 3-3 was set therein. The brush of which area of the edge part was larger on average by 26% than the cross-sectional area of the brush at the position 50 micrometers from the end of the brush was used for the brush 22*a* in each station.

In the image forming apparatus, a color chart in which an image area was 5% was formed 5 pieces each, total 50,000 images. Halftone images of the colors were output, and high-quality images were obtained.

Example 3-5

An image forming apparatus was prepared similarly to Example 3-4 except for using acrylic thermosetting resin for the protective layer of the photoconductor and the protective-agent bar 3-4.

In the image forming apparatus, a color chart in which an image area was 5% was formed 5 pieces each, total 100,000 images. Halftone images of the colors were output, and high-quality images were obtained.

As explained above, according to the third embodiment, by using each of the brushes of which areas of the edge part were larger by 5% to 100% than the cross-sectional area of the brush at the position 50 micrometers from the end of the brush, the protective agent can be efficiently held on the edge part of the brush to be supplied to the image carrier, and thus, the protective agent can be smoothly supplied to the image carrier.

In the protective-agent supplying element, a distance from a place where an outer diameter of the end of the brush is the largest to the front edge of the brush in the longitudinal direction is 40 micrometers or less, and thus, the step of the brush has an appropriate height with respect to the protective-agent bar. Therefore, the protective agent can be smoothly supplied to the image carrier even in the initial stage of image formation (an applying brush is initially used).

Moreover, the protective agent having high protective effect of the image carrier can be efficiently supplied to the image carrier through the brush of the protective-agent supplying element.

In the protective-layer forming device, the protective agent having high protective effect of the image carrier can be efficiently supplied to the image carrier through the brush of the protective-agent supplying element, and the film-formed protective agent can be formed on the image carrier.

The image carrier and the protective-layer forming device that forms the protective layer on the image carrier are incorporated in the cartridge, and thus, it is possible to realize a long-life process cartridge.

The image forming apparatus includes the image carrier and the protective-layer forming device that forms the protective layer on the image carrier, and thus, it is possible to realize the image forming apparatus capable of maintaining long life of the image carrier and forming high-quality images.

Furthermore, the image forming apparatus includes the process cartridge, and thus, it is possible to realize the image forming apparatus capable of maintaining long life of the process cartridge and forming high-quality images.

Moreover, it is possible to realize the image forming apparatus capable of maintaining long life of the image carrier or of the process cartridge and forming high-quality multicolor or full color images.

As set forth hereinabove, according to an embodiment of the present invention, lubricant adheres to the tip of the brush, and is held on the image carrier essentially in an irregular form. This prevents the lubricant from moving to other portions than the image carrier as well as mixing into a developer. Besides, when the charging roller is charged with alternating current (AC), the lubricant is prevented from flying onto the charging roller. Even if it flies onto the charging roller, the lubricant disappears in a short time. Therefore, the resistance of the charging roller does not increase. This results in less generation of oxidized gas such as ozone and NOx, and charging characteristics can be stabilized with respect to the image carrier.

Moreover, a protective agent to be supplied to the image carrier can be increased while the vulnerability of the protective-agent bar is eliminated. The increase in the sliding resistance between the cleaning element of the image carrier and the image carrier can be prevented.

Furthermore, when the hydrophobic organic matter is decomposed by the energy of charging to be ionic conductive material, the ionic conductive material is easily involved by the amphiphilic organic matter, which prevents the conductive properties from being imparted to a latent image, and occurrence of image blur due to variation of the potential of the latent image can be prevented.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier;

a charging unit that uniformly charges the image carrier;

a developing unit that develops an electrostatic latent image formed on the image carrier to obtain a toner image as a visual image;

a transfer unit that transfers the toner image onto a transfer material;

a cleaning unit that removes toner remaining on the image carrier;

a protective-agent bar that contains a protective agent; and a protective-agent supplying unit that comprises a brush that rotates to supply the protective agent to the image carrier, wherein the brush is configured to be in contact with the protective-agent bar and the image carrier such that the protective agent adheres to the brush, and is supplied to a surface of the image carrier;

fine powder of the protective agent is not formed upon pressure from the brush onto the protective-agent bar; and the protective agent has a surface hardness softer than a pencil hardness of 5B.

2. The image forming apparatus according to claim 1, wherein the charging unit includes a charging roller that is in contact with or closely faces the image carrier, and that is applied with a direct current voltage and an alternating current voltage superimposed upon each other.

3. The image forming apparatus according to claim 1, wherein the protective agent is applied to the image carrier before an image is formed.

4. The image forming apparatus according to claim 1, wherein the protective agent is applied to the image carrier when any unit that faces and comes into contact with the image carrier is not in contact with the image carrier.

5. The image forming apparatus according to claim 1, wherein the protective-agent bar is made of a material having at least one endothermic peak in a range of 50° C. to 130° C.

6. The image forming apparatus according to claim 1, wherein the protective agent contains an amphiphilic organic compound.

7. The image forming apparatus according to claim 6, wherein the amphiphilic organic compound has a hydrophile-lipophile balance of 1.0 to 6.5.

8. The image forming apparatus according to claim 6, wherein the amphiphilic organic compound is a nonionic surfactant.

9. The image forming apparatus according to claim 6, wherein the protective agent further contains a hydrophobic organic compound.

10. The image forming apparatus according to claim 9, wherein the hydrophobic organic compound is paraffin.

11. The image forming apparatus according to claim 9, wherein a weight ratio of the hydrophobic organic compound to the amphiphilic organic compound is in a range of 10/90 to 97/3.

12. The image forming apparatus according to claim 1, wherein the protective agent is supplied to the image carrier so that an amount of protective agent contained in waste toner is 20% or less of a total of the protective agent supplied to the image carrier.

13. The image forming apparatus according to claim 1, further comprising, at least one of:

a pressing mechanism that presses the protective-agent bar against the brush to cause the protective agent to adhere to the brush; and a protective-layer forming mechanism that forms the protective agent on the image carrier into a thin layer.

14. The image forming apparatus according to claim 1, wherein an area of an end of the brush is larger by 5% to 100% than a cross-sectional area of the brush at a position 50 micrometers from the end of the brush.

15. The image forming apparatus according to claim 1, wherein a length in a longitudinal direction of the brush from where an outer diameter of an end of the brush is longest to a top-most end of the brush is 40 micrometers or less.

16. The image forming apparatus according to claim 1, wherein the protective agent contains 50% or more by weight of a hydrophobic component.

17. The image forming apparatus according to claim 1, wherein the protective agent contains 3% or more by weight of an amphiphilic organic compound.

18. A process cartridge comprising therein at least one of:

an image carrier that carries an electrostatic latent image;

a protective-layer forming unit that supplies a protective agent having a surface hardness softer than a pencil hardness of 5B to a surface of the image carrier to protect the surface;

a charging unit that charges the image carrier;

a developing unit that develops the electrostatic latent image on the image carrier to obtain a toner image as a visual image;

a transfer unit that transfers the toner image onto a transfer material; and a cleaning unit that removes toner remaining on the image carrier.

* * * * *